US009327522B2

(12) United States Patent
Hayashi et al.

(10) Patent No.: US 9,327,522 B2
(45) Date of Patent: May 3, 2016

(54) IMAGE RECORDING APPARATUS HAVING AN IRRADIATOR WITH DIRECTIONALITY IN THE TRANSPORT DIRECTION

(71) Applicant: SEIKO EPSON CORPORATION, Tokyo (JP)

(72) Inventors: Yoshimitsu Hayashi, Shimosuwa-machi (JP); Kazuhito Hori, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 14/223,671

(22) Filed: Mar. 24, 2014

(65) Prior Publication Data

US 2014/0292968 A1 Oct. 2, 2014

(30) Foreign Application Priority Data

Mar. 29, 2013 (JP) ..... 2013-071615

(51) Int. Cl.
*B41J 2/01* (2006.01)
*B41J 11/00* (2006.01)
*B41J 3/54* (2006.01)

(52) U.S. Cl.
CPC ..... *B41J 11/002* (2013.01); *B41J 3/543* (2013.01)

(58) Field of Classification Search
CPC .... B41J 11/0015; B41J 11/002; B41J 25/304; B41J 2/2114
See application file for complete search history.

(56) References Cited

U.S. PATENT DOCUMENTS 8,162,468 B2 * 4/2012 Kulpa ..... B41J 11/002 347/102

FOREIGN PATENT DOCUMENTS

JP 2004-284141 * 10/2004
JP 2004-338223 12/2004

* cited by examiner

*Primary Examiner* — Juanita D Jackson
(74) *Attorney, Agent, or Firm* — Workman Nydegger

(57) ABSTRACT

An image recording apparatus includes a first print head that discharges a first liquid that is cured through irradiation of light from a nozzle towards the recording medium; a second print head that discharges a second liquid in which a content rate of a tri-functional or higher polyfunctional monomer is different from that of the first liquid and that is cured through irradiation of light from a nozzle towards the recording medium, and is provided at a different position in the transport direction from the first print head; and an irradiator that irradiates the recording medium with light, and is arranged between the print heads in the transport direction, in which the irradiator emits light having directionality in a direction receding in the transport direction from a print head that discharges a liquid with a higher content rate from the print heads.

15 Claims, 7 Drawing Sheets

FIG. 2

| USAGE | NAME | ABBREVIATION | CONTENT RATE OF EACH COMPONENT (%) | | | |
|---|---|---|---|---|---|---|
| | | | C | M | Y | K |
| POLYMERIZABLE COMPOUND (ESTER (METH) ACRYLATE CONTAINING VINYL GROUP) | (2-(2-VINYLOXY-ETHOXY) ETHYL, PRODUCT NAME, MANUFACTURED BY NIPPON SHOKUBAI CO., LTD.) | VEEA | 20.0 | 20.0 | 20.0 | 20.0 |
| POLYMERIZABLE COMPOUND (MONOFUNCTIONAL (METH) ACRYLATE) | BISCOAT #192 (PHENOXYETHYL ACRYLATE, PRODUCT NAME MANUFACTURED BY OSAKA ORGANIC CHEMICAL INDUSTRY LTD.) | PEA | 40.0 | 40.0 | 40.0 | 40.0 |
| POLYMERIZABLE COMPOUND (POLYFUNCTIONAL (METH) ACRYLATE) | NK ESTER APG-10 (DIPROPYLENEGLYCOL ACRYLATE, PRODUCT NAME MANUFACTURED BY SHIN-NAKAMURA CHEMCICAL CO., LTD) | DPGDA | 17.6 | 24.1 | 24.1 | 18.1 |
| POLYMERIZABLE COMPOUND (POLYFUNCTIONAL (METH) ACRYLATE) | A-DPH (DIPENTAERYTHRITOL HEXACRYLATE, PRODUCT NAME MANUFACTURED BY SHIN-NAKAMURA CHEMICAL CO., LTD) | A-DPH | 8.0 | — | — | 8.0 |
| PHOTOPOLYMERIZATION INITIATOR | IRGACURE 819 (PRODUCT NAME MANUFACTURED BY BASF, SOLID CONTENT 100%) | Irgacure819 | 3.0 | 3.0 | 3.0 | 3.0 |
| PHOTOPOLYMERIZATION INITIATOR | DAROCURTPO (PRODUCT NAME, MANUFACTURED BY CHIBA SPECIALTY CHEMICALS) | DarocurTPO | 5.0 | 5.0 | 5.0 | 5.0 |
| PHOTOPOLYMERIZATION INITIATOR | SPEEDCURE DETX (PRODUCT NAME MANUFACTURED BY LAMBSON, SOLID CONTENT 100%) | Speedcure DTEX | 2.5 | 3.8 | 3.8 | 2.5 |
| LEAVENING AGENT (SURFACTANT) | BYK-UV3500 (PRODUCT NAME MANUFACTURED BY BYK) | BYK UV3500 | 0.5 | 0.5 | 0.5 | 0.5 |
| DISPERSANT | SOLSPERSE 32000 (PRODUCT NAME MANUFACTURED BY LUBRIZOL) | SOL32000 | 1.0 | 1.0 | 1.0 | 1.0 |
| CYAN PIGMENT | IRGALITE BLUE GLVO (CYAN PIGMENT (C.I. PIGMENT BLUE 15:3, PRODUCT NAME MANUFACTURED BY BASF) | PB 15:3 | 2.4 | — | — | — |
| YELLOW PIGMENT | NOVOPERM YELLOW 4G01 (YELLOW PIGMENT (C.I. PIGMENT YELLOW 155), PRODUCT NAME MANUFACTURED BY CLARIANT) | PY155 | — | — | 2.6 | — |
| MAGENTA PIGMENT | CROMOPHTAL PINKPT (MAGENTA PIGMENT (C.I. PIGMENT RED 122), PRODUCT NAME MANUFACTURED BY BASF) | PR122 | — | 2.6 | — | — |
| BLACK PIGMENT | MICROLITH-WA BLACK C-WA (BLACK PIGMENT (C.I. PIGMENT BLACK 7) PRODUCT NAME MANUFACTURED BY BASF) | CB | — | — | — | 1.9 |
| TOTAL | | | 100.0 | 100.0 | 100.0 | 100.0 |

FIG. 3

INK DISCHARGE STATE

| COLOR | ACCUMULATED LIGHT AMOUNT ($mJ/cm^2$) | | | |
|---|---|---|---|---|
| | 0 | 5 | 10 | 15 |
| MAGENTA | ○ | ○ | ○ | ○ |
| YELLOW | ○ | ○ | ○ | ○ |
| CYAN | ○ | ○ | △ | × |
| BLACK | ○ | ○ | × | × |

○: EXCELLENT
△: GOOD
×: POOR

IMAGE RECORDING APPARATUS HAVING AN IRRADIATOR WITH DIRECTIONALITY IN THE TRANSPORT DIRECTION

BACKGROUND

1. Technical Field

The present invention relates to a technology in which an irradiator that irradiates a liquid with light by which the liquid is cured in an image recording technology in which a plurality of print heads that discharge a photocurable liquid are used.

2. Related Art

Image recording apparatuses, such as an ink jet printer, that perform image recording by discharging a photocurable liquid from the nozzles of a print head, and curing the liquid discharged onto the recording medium through light from an irradiator are known in the related art. In such an image recording apparatus, because the print head and the irradiator are arranged lined up, a problem arises in which light is incident on a nozzle forming surface (discharge surface) of the print head, and liquid attached to the nozzle forming surface is cured, as indicated by JP-A-2004-338223. If liquid attached to the nozzle forming surface is cured, there is concern of defects occurring in the image recording. In JP-A-2004-338223, maintenance in which the cured liquid is wiped from the nozzle forming surface is proposed.

JP-A-2004-284141 responds to the problem by suppressing the light incident on the nozzle forming surface of the print head. More specifically, light in the configuration is irradiated from the irradiator in a direction receding from the print head by inclining the irradiator arranged lined up with the print head, and the incidence of light on the nozzle forming surface is suppressed.

In the configuration that inclines the irradiator as in JP-A-2004-284141, because the incidence of light on the nozzle forming surface can be suppressed, it is possible for the liquid attached to the nozzle forming surface to not be cured, or curing to be kept to a minimum. Therefore, even when performing maintenance such as in JP-A-2004-338223, for example, there is an advantage of the liquid being easily wiped away. However, in an image recording apparatus that performs image recording by ejecting the liquid from a plurality of print heads lined up in the transport direction while transporting the recording medium in the transport direction, there is concern of the advantage according to the configuration in which the irradiator is inclined being insufficiently utilized.

In other words, in the image recording apparatus using a plurality of print heads, there are cases in which the irradiator is arranged between adjacent print heads. When the irradiator is inclined in such a case, even though it is possible for the incidence of light with respect to the nozzle forming surface of the print head on one side of the irradiator to be definitely suppressed, the incident of light with respect to the nozzle forming surface of the print head on the other side of the irradiator increases instead. As a result, the liquid attached to the nozzle forming surface of the print head on the other side is cured to a corresponding extent, and for example, a situation may occur in which the liquid is not easily removed by the maintenance such as wiping.

SUMMARY

An advantage of some aspects of the invention is to provide a technology able to effectively respond to the problem of liquid attached to the nozzle forming surface being cured by the incidence of light in an image recording technology that emits light from an irradiator provided between each print head while discharging a photocurable liquid from a plurality of print heads.

According to an aspect of the invention, there is provided an image recording apparatus including a transport unit that transports a recording medium in a transport direction; a first print head that discharges a first liquid that is cured through irradiation of light from a nozzle formed in a nozzle forming surface towards the recording medium; a second print head that is provided at a different position in the transport direction from the first print head to discharge a second liquid in which a content rate of a tri-functional or higher polyfunctional monomer is different from that of the first liquid and that is cured through irradiation of light from a nozzle formed in a nozzle forming surface towards the recording medium, and a first irradiator that is arranged between the first print head and the second print head in the transport direction to irradiate the recording medium with light, in which the first irradiator emits light having directionality in a direction receding in the transport direction from a print head that discharges a liquid with a higher content rate from the first print head or the second print head.

According to the aspect of the invention (image recording apparatus), the first print head and the second print head are provided at different positions in the transport direction of the recording medium, and the irradiator (first irradiator) is provided between the first print head and the second print head. The first print head discharges the photocurable first liquid from the nozzle, and the second print head discharges the photocurable second liquid with a different composition to the first liquid from the nozzle. More specifically, the first liquid and the second liquid have compositions with content rates of the tri-functional or higher polyfunctional monomer which are different from one another. Here, because the polyfunctional monomer has a greater number of bonds compared to a monofunctional monomer, the bonding force when cured is greater than the monofunctional monomer. Therefore, in a case in which the liquid with a higher content rate of polyfunctional monomer is attached to the nozzle forming surface and cured, the removal thereof has a tendency to be difficult. Meanwhile, removal of the liquid with a lower content rate of polyfunctional monomer is comparatively easy, even in a case of being attached to the nozzle forming surface and cured. That is, in the aspect of the invention, the respective print heads which are arranged at both sides of the irradiator are configured to discharge liquids with different eases of removal during curing. Moreover, light having directionality in a direction receding from the print head that ejects the liquid with the higher content rate of polyfunctional monomer, that is, the liquid with greater difficulty of removal during curing, in the transport direction is emitted from the irradiator. As a result, because the incidence of light is suppressed with respect to the nozzle forming surface of the print head that discharges the liquid with the greater difficulty of removal during curing, the occurrence of problems caused by the incidence of light on the nozzle forming surface are effectively suppressed. Meanwhile, in a case of irradiating light having such directionality, comparatively more light is incident on the nozzle forming surface of the print head that discharges the liquid with the lower content rate of polyfunctional monomer, that is, the liquid with the greater ease of removal during curing. However, because the print head discharges a liquid that is comparatively easy to remove during curing, the occurrence of problems caused by the incidence of light on the nozzle forming surface is effectively suppressed by appropriately performing maintenance, such as wiping. In this way, in the aspect of the invention, it is possible to effectively suppress the problem of liquid attached to the nozzle forming surface curing due to the incidence of light with respect to either of the print heads arranged on both sides of the irradiator.

Various forms of maintenance for removing liquid attached to the nozzle forming surface are considered, and, for example, a worker may perform wiping with respect to the nozzle forming surface with a manual procedure. Alternatively, a configuration may further include a maintenance mechanism that cleans the nozzle forming surface of the first print head and the nozzle forming surface of the second print head using a cleaning solution, and the solubility of the first liquid and the second liquid cured by light with respect to the cleaning solution is greater for the liquid with the lower content rate. As described above, comparatively more light is incident on the print head that discharges the liquid with a lower content rate of polyfunctional monomer from the first print head and the second print head provided on both sides of the irradiator. However, since the solubility with respect to cleaning solution used in the maintenance mechanism is greater for the liquid with a lower content rate of the polyfunctional monomer, liquid (liquid with a smaller content rate of polyfunctional monomer) attached to the nozzle forming surface of the print head on which comparatively more light is incident may be removed by being effectively dissolved in the cleaning solution.

In the image recording apparatus of the aspect, the number of print heads and irradiators may be increased as appropriate. In such a case, it is possible to effectively suppress problems of the liquid attached to the nozzle forming surface of each print head being cured due to the incident light by setting the direction of the directionality of light emitted by the irradiator arranged between two arbitrary print heads adjacent each other in the transport direction to a direction receding from the print head that discharges the liquid with the higher content rate of polyfunctional monomer in the transport direction.

For example, in a case in which three or more print heads are provided, the three print heads and the irradiator arranged therebetween lined up continuously in the transport direction may be configured as below. That is, according to the aspect of the invention, the image recording apparatus may further include a third print head that discharges a third liquid that is cured through irradiation of light toward the recording medium, and a second irradiator that irradiates the recording medium with light, in which the first print head, the first irradiator, the second print head, the second irradiator, and the third print head are arranged in that order from the upstream side in the transport direction towards the downstream side, the second print head discharges the second liquid in which the content rate is lower than the first liquid and the third liquid, the first irradiator emits light having directionality in a direction receding from the first print head in the transport direction, and the second irradiator emits light having directionality in a direction receding from the third print head in the transport direction. At this time, the color of the second liquid may be magenta, the color of the first liquid may be one of either cyan or black, and the color of the third liquid may be the other of either cyan or black. Furthermore, the color of the first liquid may be cyan, and the color of the third liquid may be black.

Meanwhile, in a case in which three or more print heads are provided, the three print heads and the irradiator arranged therebetween lined up continuously in the transport direction may be configured as below. That is, according to the aspect of the invention, the image recording apparatus may further include a third print head that discharges a third liquid that is cured through irradiation of light toward the recording medium, and a second irradiator that irradiates the recording medium with light, in which the first print head, the first irradiator, the second print head, the second irradiator, and the third print head are arranged in that order from the upstream side in the transport direction towards the downstream side, the second print head discharges the second liquid in which the content rate is higher than the first liquid and the third liquid, the first irradiator emits light having directionality in a direction receding from the second print head in the transport direction, and the second irradiator emits light having directionality in a direction receding from the second print head in the transport direction. At this time, the color of the second liquid may be black, the color of the first liquid may be one of either magenta or yellow, and the color of the third liquid may be the other of either magenta or yellow. Furthermore, the color of the first liquid may be magenta, and the color of the third liquid may be yellow.

In a case in which four or more print heads are provided, the four print heads and the irradiators arranged therebetween lined up continuously in the transport direction may be configured as below. That is, according to the aspect of the invention, the image recording apparatus may further include a third print head that discharges a third liquid that is cured through irradiation of light towards the recording medium; a fourth print head that discharges a fourth liquid that is cured through irradiation of light towards the recording medium; a second irradiator that irradiates the recording medium with light; and a third irradiator that irradiates the recording medium with light, in which the first print head, the first irradiator, the second print head, the second irradiator, the third print head, the third irradiator, and the fourth print head are arranged in that order from the upstream side in the transport direction towards the downstream side, the second print head discharges the second liquid in which the content rate is lower than the first liquid, the third print head discharges the third liquid in which the content rate is higher than the second liquid, the fourth print head discharges the fourth liquid in which the content rate is lower than the third liquid, the first irradiator emits light having directionality in a direction receding from the first print head in the transport direction, the second irradiator emits light having directionality in a direction receding from the third print head in the transport direction, and the third irradiator emits light having directionality in a direction receding from the third print head in the transport direction. At this time, the color of the first liquid may be cyan, the color of the second liquid may be magenta, the color of the third liquid may be black and the color of the fourth liquid may be yellow.

In this case, it is preferable that a fourth irradiator that irradiates the recording medium with light be arranged further to the downstream side in the transport direction from the fourth print head, and the fourth irradiator emits light having directionality in a direction perpendicular with respect to the transport direction or a direction receding from the fourth print head in the transport direction. In this way, the liquid discharged from the fourth head may be reliably cured by including the fourth irradiator further to the downstream side in the transport direction from the fourth head. Furthermore, since the light emitted by the fourth irradiator has directionality in a direction perpendicular with respect to the transport direction or in a direction receding from the fourth print head in the transport direction, the incidence of light on the nozzle forming surface of the fourth print head may be suppressed.

Incidentally, although the polyfunctional monomer may employ various monomers if the monomers are tri-functional or higher, for example, a heptafunctional or higher monomer may be used.

The direction of the directionality of light emitted by the radiator may be regulated using various methods. For example, each irradiator may include a housing in which an opening is provided opposing a recording medium, and a light source that is provided in the housing to emit light; in which the direction for the directionality of light emitted by each irradiator is regulated by disposing irradiators such that the optical axis of the light source is inclined with respect to a perpendicular line descending from the light source to the recording medium. Alternatively, each irradiator may include a housing in which an opening is provided opposing the recording medium, and a light source that is provided in the housing to emit light, in which the direction of the directionality of light emitted by each irradiator is regulated by the position of the opening with respect to the light source in the transport direction.

The configuration may further include a cylindrical support member that includes a rotary axis orthogonal to the transport direction and that supports the recording medium with an outer peripheral surface, in which each print head and each irradiator is arranged along the outer peripheral surface.

BRIEF DESCRIPTION OF THE DRAWINGS

The invention will be described with reference to the accompanying drawings, wherein like numbers reference like elements.

FIG. 2 is a diagram showing the composition of each color of UV ink in the present embodiment.

FIG. 3 is a diagram showing the removal effect of each color of UV ink due to wiping using a cleaning solution.

DESCRIPTION OF EXEMPLARY EMBODIMENTS

Figure 1:
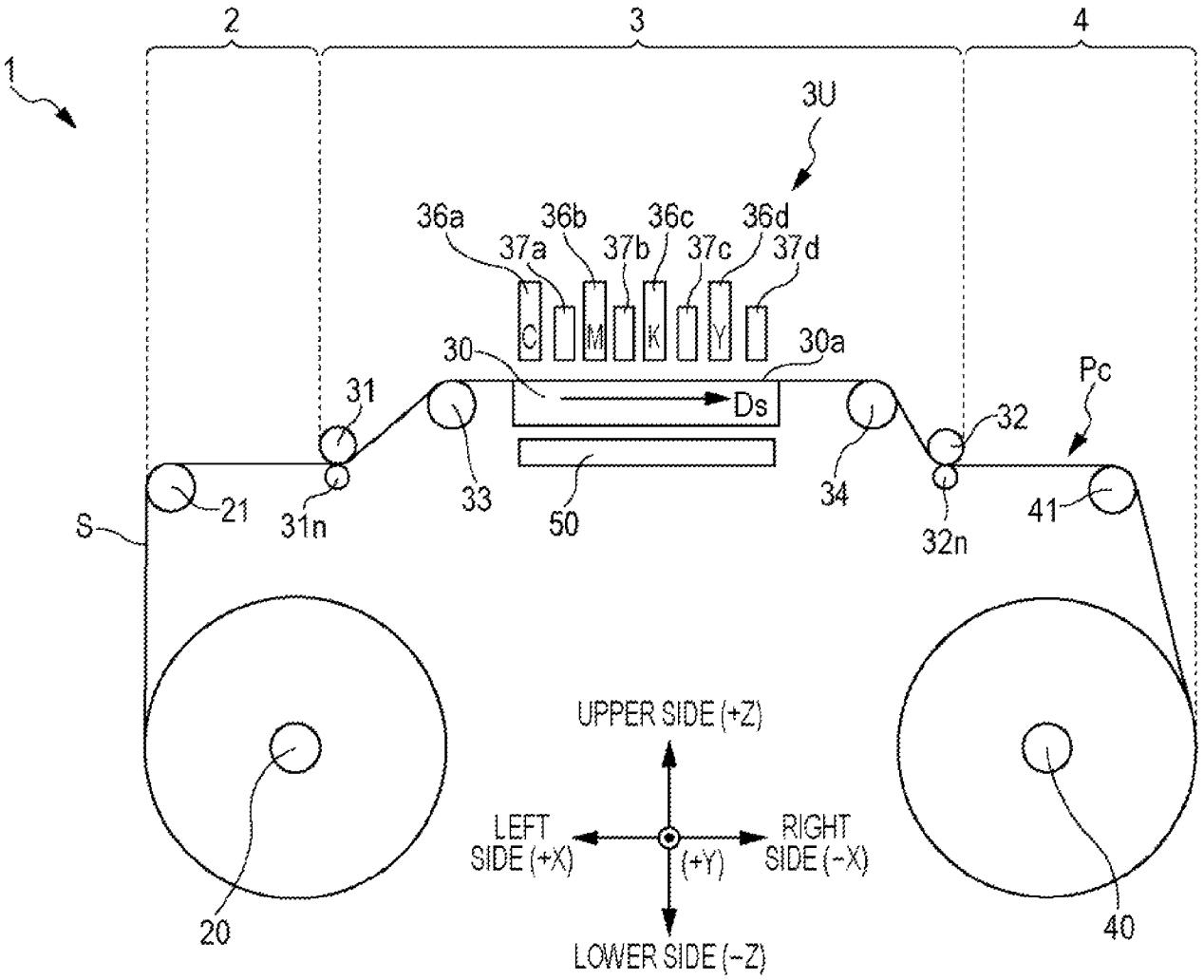
FIG. 1 is a front view schematically showing a configuration of an image recording apparatus to which the invention is applicable.

Below, embodiments of the image recording apparatus according to the invention will be described with reference to the drawings. FIG. 1 is a front view schematically showing an embodiment of an image recording apparatus to which the invention is applicable. In FIG. 1 or later drawings, in order to clarify the placement relationship of each portion of the apparatus, a three-dimensional Cartesian coordinate system which corresponds to the left to right direction X, the front to rear direction Y, and the vertical direction Z of the image recording apparatus 1 is adopted as necessary.

As shown in FIG. 1, in the image recording apparatus 1, a feeding portion 2, a processing portion 3, and a winding portion 4 are arranged in the left to right direction. The feeding portion 2 and the winding portion 4 have a feeding shaft 20 and a winding shaft 40 respectively. Both ends of a sheet S (web) are wrapped around the feeding portion 2 and the winding portion 4 to have a roll shape and the sheet is suspended over the gap therebetween. The sheet S thus suspended along the transport path Pc is transported to the winding shaft 40 after being transported to the processing portion 3 from the feeding shaft 20 and undergoes image recording processing by an image recording unit 3U. The types of sheet S are broadly classified into paper-based and film-based. Specific examples thereof include, for the paper-based, high quality paper, cast paper, art paper, and coated paper, and, for the film-based, synthetic paper, polyethylene terephthalate (PET), and polypropylene (PP). In the description below, from both surfaces of the sheet S, the surface on which an image is recorded is referred to as the front surface, and the surface of the opposite side is referred to as the rear surface.

The feeding portion 2 includes a feeding shaft 20 on which an end of the sheet S is wrapped, and a driven roller 21 onto which the sheet S drawn from the feeding shaft 20 is rolled up. The feeding shaft 20 supports the end of the sheet S by wrapping in a state in which the front surface of the sheet S faces the outside. The sheet S wrapped around the feeding shaft 20 is fed to the processing portion 3 via the driven roller 21 by the feeding shaft 20 rotating clockwise in the paper surface in FIG. 1.

The processing portion 3 executes image recording on the sheet S by appropriately performing processing with the image recording unit 3U arranged along the surface of a platen 30 while supporting the sheet S fed from the feeding portion 2 with the flat-type platen 30 having a planar supporting surface. In the processing portion 3, a front driving roller 31 and a rear driving roller 32 are provided at both ends of the platen 30, and the sheet S transported from the front driving roller 31 to the rear driving roller 32 is supported on the platen 30, and undergoes image printing.

The front driving roller 31 has a plurality of fine projections formed by thermal spraying on the outer peripheral surface, and winds up the sheet S fed from the feeding portion 2 from the front surface side. By the front driving roller 31 rotating counter-clockwise in the paper surface in FIG. 1, the sheet S fed from the feeding portion 2 is transported to the downstream side of the transport path Pc. A nip roller 31*n* is provided with respect to the front driving roller 31. The nip roller 31*n* abuts on the rear surface of the sheet S in a state of being biased toward the front driving roller 31 side, and the sheet S is interposed between the front driving roller 31 and the nip roller 31*n*. Thereby, the frictional force between the front driving roller 31 and the sheet S is secured, and transport of the sheet S by the front driving roller 31 may be reliably performed.

In the flat platen 30, the support surface 30*a* (upper surface) that supports the sheet S is supported to be horizontal by a support mechanism not shown in the drawings. Driven rollers 33 and 34 are provided on both the left and right sides of the platen 30, and the driven roller 33 and 34 wind up the sheet S transported from the front driving roller 31 to the rear driving roller 32 from the rear surface side. The upper end positions of the driven rollers 33 and 34 are arranged to be flush with or slightly below the surface of the platen 30, and are configured such that it is possible to maintain a state in which the sheet S transported from the front driving roller 31 to the rear driving roller 32 abuts on the platen 30.

The rear driving roller 32 has a plurality of fine protrusions formed by thermal spraying on the outer peripheral surface thereof, and winds up the sheet S transported from the platen 30 via the driven roller 34 from the front surface side. The rear driving roller 32 transports the sheet S to the winding portion 4 by rotating counter-clockwise in the paper surface of FIG. 1. A nip roller 32*n* is provided with respect to the rear driving roller 32. The nip roller 32*n* abuts on the rear surface of the sheet S in a state of being biased toward the rear driving roller 32 side, and the sheet S is interposed between the rear driving roller 32 and the nip roller 32*n*. Thereby, the frictional force between the rear driving roller 32 and the sheet S is secured, and transport of the sheet S by the rear driving roller 32 may be reliably performed.

In this way, the sheet S transported from the front driving roller 31 to the rear driving roller 32 is transported on the platen 30 while being supported by the platen 30 in the transport direction Ds. An image recording unit 3U is provided in the processing portion 3 for printing a color image with respect to front surface of the sheet S supported by the platen 30. More specifically, the image recording unit 3U has four print heads 36*a* to 36*d* lined up from the upstream side toward the downstream side along the transport direction Ds. The print heads 36*a* to 36*d* discharge cyan (C), magenta (M), black (K), and yellow (Y) inks, respectively. Each of the print heads 36*a* to 36*d* opposes the front surface of the sheet S supported on the platen 30 with a slight clearance, and discharges ink with the corresponding color using an ink jet method. Then, a color image is formed on the front surface of the sheet S by each print head 36*a* to 36*d* discharging ink with respect to the sheet S transported along the transport direction Ds.

Additionally, a UV (ultraviolet) ink (photocurable ink) that is cured by being irradiated with ultraviolet rays (light) is used as the ink. The image recording unit 3U has irradiators 37*a* to 37*d* that irradiate ultraviolet rays in order for ink to be fixed to the sheet S by being cured. The ink curing is executed by dividing into two stages of provisional curing and main curing. Provisional curing irradiators 37*a* to 37*c* are each provided between in the spaces between the print heads 36*a* to 36*d*. In other words, the irradiators 37*a* to 37*c* irradiate ultraviolet rays with a comparatively low accumulated light amount, ink is cured (provisional curing) to the extent that the ink keeps its shape, and the ink is not completely cured. Meanwhile, a main curing irradiator 37*d* is provided on the downstream side with respect to print heads 36*a* to 36*d* in the transport direction Ds. In other words, the irradiator 37*d* subjects the ink to main curing by irradiating a comparatively more ultraviolet rays than the irradiator 37*a*. In the present embodiment, main curing not only indicates ink being completely cured, but also includes curing to the extent that ink landed on the sheet S is prevented from wetting and spreading. It is possible for a color image that is formed by the print heads 36*a* to 36*d* to be attached to the front surface of the sheet S by executing provisional curing and main curing.

In this way, in the processing portion 3, the discharging and curing of ink is executed as appropriate with respect to the sheet S supported by the platen 30, and the color image is formed. The sheet S on which the color image is formed is transported to the winding portion 4 by the rear driving roller 32.

The winding portion 4 includes a winding shaft 40 on which the end of the sheet S wrapped, and a driven roller 41 on which the sheet S transported to the winding shaft 40 is wound up. The winding shaft 40 supports the end of the sheet S by wrapping in a state in which the front surface of the sheet S faces the outside. The sheet S is wrapped around the winding shaft 40 through the driven roller 41 by the winding shaft 40 rotating clockwise in the paper surface of FIG. 1.

A maintenance unit 50 that executes maintenance with respect to the print heads 36*a* to 36*d* is provided in the image recording apparatus 1. The maintenance unit 50 is able to execute wiping with respect to the nozzle forming surface 362 in which the nozzles 361 (refer to FIG. 4) of each print head 36*a* to 36*d* are formed, and is able to remove, through the wiping, UV ink attached to the nozzle forming surface 362. During wiping by the maintenance unit 50, ethyl diglycol acetate (EDGAC) in which the UV ink is soluble is used as the cleaning solution. By using such a cleaning solution, it is possible not only to simply wipe away UV ink attached to the nozzle forming surface 362 by wiping, but also possible to suitably remove UV ink for which curing on the nozzle forming surface 362 is progressing by being dissolved in the cleaning solution. As the cleaning solution, a UV ink not including a pigment, that is, a transparent UV ink may be used instead of the EDGAC.

The maintenance unit 50 is provided adjacent to the platen 30 in the Y direction. The print heads 36*a* to 36*d* are freely movable in the Y direction between above the platen 30 and above the maintenance unit 50, and are configured such that the print heads 36*a* to 36*d* are positioned above the platen 30 during printing operations, whereas the print heads 36*a* to 36*d* are positioned above the maintenance unit 50 during maintenance.

Next, the composition of the UV ink will be described. The following composition is ordinarily used as the UV ink. In the following description, the term "(meth)acrylate" means at least one of either acrylate or methacrylate corresponding thereto, and the term "(meth)acryl" means at least one of either acryl or methacryl corresponding thereto.

In the following description, the term "curable" indicates the characteristic of being polymerized and cured in the presence of or not in the presence of a photopolymerization initiator. The term "discharge stability" indicates the characteristic by which ordinarily stable ink droplets are discharged from the nozzles without clogging of the nozzles.

Polymerizable Compound

The polymerizable compound included in the ink composition of the embodiment polymerizes during ultraviolet light irradiation due to the action of the polymerization initiator described below, and the UV ink is able to be polymerized.

Monomer A

The monomer A that is the polymerizable compound is an ester (meth)acrylate containing a vinyl ester group, and is represented by the general formula (I) below.

$$CH^2{=}CR^1{-}COOR^2{-}O{-}CH{=}CH{-}R^3 \quad (I)$$

(In the formula, $R^1$ is a hydrogen atom or methyl group, $R^2$ is a divalent organic residue with 2 to 20 carbon atoms, and $R^3$ is a hydrogen atom or a monovalent organic residue with 1 to 11 carbon atoms)

It is possible for the curability of the ink to be satisfactory due to the ink composition containing the monomer A.

In the above general formula (I), a linear, branched or cyclic alkylene group with 2 to 20 carbon atoms, an alkylene group with 2 to 20 carbon atoms having an oxygen atom due to an ether bond and/or an ester bond in the structure, or a divalent aromatic group which may be substituted by 6 to 11 carbon atoms are suitable as the divalent organic residue with 2 to 20 carbon atoms represented by $R^2$. Among these, an alkylene group with 2 to 6 carbon atoms, such as an ethylene group, an n-propylene group, an isopropylene group and a butylene group, and an alkylene group with 2 to 9 carbon atoms having an oxygen atom due to an ether bond in the structure, such as an oxyethylene group, an oxy-n-propylene group, an oxyisopropylene group, and an oxybutylene group may be suitably used.

In the above general formula (I), a linear, branched or cyclic alkyl group with 1 to 10 carbon atoms and an aromatic group that may be substituted with 6 to 11 carbon atoms are suitable as the monovalent organic group with 1 to 11 carbon atoms represented by $R^3$. Among these, an alkyl group with 1 to 2 carbon atoms that is a methyl group or an ethyl group, and an aromatic group with 6 to 8 carbon atoms such as a phenyl group and a benzyl group.

In the case of a group that may be substituted with the above organic residue, the substituent may be divided into a group including carbon atoms and a group not including carbon atoms. First, in the case of the substituent being a group that includes carbon atoms, the carbon atoms are counted towards the number of carbon atoms in the organic residue. Although not limited to the following, examples of the group including carbon atoms include, for example, a carboxyl group and an alkoxy group. Next, although not limited to the following, examples of the group not including carbon atoms include, for example, a hydroxyl group and a halo group.

Examples of the monomer A described above include, but are not limited to, 2-vinyloxyethyl (meth)acrylate, 3-vinyloxypropyl (meth)acrylate, 1-methyl-2-vinyloxyethyl (meth) acrylate, 2-vinyloxy propyl (meth)acrylate, 4-vinyloxybutyl (meth)acrylate, 1-methyl-3-vinyloxypropyl (meth)acrylate, 1-vinyloxymethyl propyl(meth)acrylate, 2-methyl-3-vinyloxypropyl(meth)acrylate, 1,1-dimethyl-2-vinyloxyethyl (meth)acrylate, 3-vinyloxybutyl (meth)acrylate, 1-methyl-2-vinyloxy propyl(meth)acrylate, 2-vinyloxybutyl (meth)acrylate, 4-vinyloxyethyl cyclohexyl (meth)acrylate, 6-vinyloxyhexyl (meth)acrylate, 4-vinyloxymethyl cyclohexyl methyl (meth)acrylate, 3-vinyloxymethyl cyclohexylmethyl (meth) acrylate, 2-vinyloxymethyl cyclohexyl methyl (meth)acrylate, p-vinyloxymethyl phenyl methyl (meth)acrylate, m-vinyloxymethyl phenyl methyl (meth)acrylate, o-vinyloxymethyl phenyl methyl (meth)acrylate, 2-(vinyloxyethoxy) ethyl (meth)acrylate, 2-(vinyloxyisopropoxy) ethyl (meth)acrylate, 2-(vinyloxyethoxy) propyl (meth)acrylate, 2-(vinyloxyethoxy) isopropyl (meth)acrylate, 2-(vinyloxyisopropoxy) propyl (meth)acrylate, 2-(vinyloxyisopropoxy) isopropyl (meth)acrylate, 2-(vinyloxyethoxyethoxy) ethyl (meth)acrylate, 2-(vinyloxyethoxy isopropoxy) ethyl (meth)acrylate, 2-(vinyloxyisopropoxyethoxy) ethyl (meth) acrylate, 2-(vinyloxyisopropoxypropoxy) ethyl (meth)acrylate, 2-(vinyloxyethoxyethoxy) propyl (meth)acrylate, 2-(vinyloxyethoxy isopropoxy) propyl (meth)acrylate, 2-(vinyloxyisopropoxyethoxy) propyl (meth)acrylate, 2-(vinyloxyisopropoxypropoxy) propyl (meth)acrylate, 2-(vinyloxyethoxyethoxy) isopropyl (meth)acrylate, 2-(vinyloxyethoxyisopropoxy) isopropyl (meth)acrylate, 2-(vinyloxyisopropoxyethoxy) isopropyl (meth)acrylate, 2-(vinyloxyisopropoxyisopropoxy) isopropyl (meth)acrylate, 2-(vinyloxyethoxyethoxyethoxy) ethyl (meth)acrylate, 2-(vinyloxyethoxyethoxyethoxyethoxy) ethyl (meth)acrylate, 2-(isopropenoxyethoxy) ethyl (meth)acrylate, 2-(isopropenoxy ethoxyethoxy) ethyl (meth)acrylate, 2-(isopropenoxy ethoxyethoxyethoxy) ethyl (meth)acrylate, 2-(isopropenoxy ethoxyethoxyethoxyethoxy) ethyl (meth) acrylate, polyethylene glycol monovinyl ether (meth)acrylate, and polypropylene glycol monovinyl ether (meth)acrylate.

Among these, because of the low viscosity, high ignition point and superior curability, 2-(vinyloxyethoxy) ethyl (meth)acrylate, that is, at least one of either 2-(vinylethoxyethoxy) ethyl acrylate and 2-(vinyloxyethoxy) ethyl methacrylate is preferable, and 2-(vinylethoxyethoxy) ethyl acrylate is more preferable. Examples of the 2-(vinyloxyethoxy) ethyl (meth)acrylate include 2-(2-vinyloxyethoxy) ethyl (meth)acrylate and 2-(1-vinyloxyethoxy)ethyl (meth)acrylate, and examples of the 2-(vinylethoxyethoxy) ethyl acrylate include 2-(2-vinyloxyethoxy) ethyl acrylate (below, referred to as "VEER") and 2-(1-vinyloxyethoxy) ethyl acrylate.

Examples of methods for producing the monomers A include, but are not limited to, a method of esterification of a (meth)acrylic acid and a hydroxyl group-containing vinyl ether (preparation method B), a method of esterification of a (meth) acrylic halide and a hydroxyl group-containing vinyl ether (preparation method C), a method of esterification a (meth)acrylic anhydride and a hydroxyl group-containing vinyl ether (preparation method D), a method of transesterification of an ester (meth)acrylic acid and a hydroxyl group-containing vinyl ether (preparation method E), a method of esterification of a (meth)acrylic and a halogen-containing vinyl ether (preparation method F), a method of esterification of a (meth)acrylic acid alkali (earth) metal salt and a halogen-containing vinyl ether (preparation method G), a method of vinyl exchange of a hydroxyl group-containing (meth)acrylic acid ester and a vinyl carboxylic acid (preparation method H), and a method of ether exchange of a hydroxyl group-containing (meth)acrylic acid ester and a alkyl vinyl ether (preparation method I).

Polymerizable Compound Other than Monomer A

Other than the above vinyl ether-containing (meth)acrylic ester (monomer A), monofunctional, bifunctional and trifunctional or higher polyfunctional types of monomer and oligomer known in the related art may be used (below, referred to as "other polymerizable compound"). Examples of the monomer include, for example, (meth)acrylic acids, itaconic acids, crotonic acids, unsaturated carboxylic acids, such as isocrotonic acids and maleic acids, or salts thereof, or esters, urethanes, amides and anhydrides thereof, acrylonitriles, styrenes, various unsaturated polyesters, unsaturated polyethers, unsaturated polyamides and unsaturated urethanes. Examples of the oligomer include, for example, oligomers formed from the above monomers, such as linear acrylic oligomers, epoxy (meth)acrylates, oxetane (meth) acrylate, aliphatic urethane (meth)acrylate, aromatic urethane (meth)acrylate and polyester (meth)acrylate.

Other monofunctional monomers and polyfunctional monomers may include an N-vinyl compound. Examples of the N-vinyl compound include an N-vinyl formamide, an N-vinylcarbazole, an N-vinylacetamide, an N-vinyl pyrrolidone, an N-vinylcaprolactum, and acryloyl morpholine and derivatives thereof.

Among the other polymerizable compounds, esters of (meth)acrylic acid, that is (meth)acrylate, is preferable.

Among the above-mentioned (meth)acrylates, examples of the monofunctional (meth)acrylate include, for example, isoamyl (meth)acrylate, stearyl (meth)acrylate, lauryl (meth) acrylate, octyl (meth)acrylate, decyl (meth)acrylate, isomyristyl (meth)acrylate, isostearyl (meth)acrylate, 2-ethylhexyl di glycol (meth)acrylate, 2-hydroxybutyl (meth)acrylate, butoxyethyl (meth)acrylate, ethoxy diethylene glycol (meth) acrylate, methoxy diethylene glycol (meth)acrylate, methoxy polyethylene glycol (meth)acrylate, methoxy propylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 4-hydroxybutyl (meth)acrylate, 2-hydroxy-3-phenoxy propyl (meth)acrylate, lactone-modified flexible (meth)acrylate, t-butyl cyclohexyl (meth)acrylate, dicyclopentanyl (meth) acrylate, and dicyclopentenyloxyethyl (meth)acrylate.

Among the (meth)acrylates, examples of the bifunctional (meth)acrylate include, for example, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, dicyclopentanyl di(meth)acrylate, 1,6-hexanediol di(meth)acrylate, 1,9-nonane diol di(meth)acrylate, neopentyl glycol di(meth)acrylate, dimethylol-tricyclodecane di(meth)acrylate, di(meth)acrylate of EO (ethylene oxide) modified bisphenol A, di(meth)acrylate of PO (propylene oxide) modified bisphenol A, hydroxypivalic acid neopentyl glycol di(meth)acrylate, polytetramethylene glycol di(meth)acrylate, and an acrylated amine compound obtained by reacting and amine compound and 1,6-hexanediol di(meth)acrylate. As commercially available acrylated amine compounds obtained by reacting an amine compound with 1,6-hexanediol di(meth)acrylate, examples include EBECRYL 7100 (compound containing 2 amino groups and 2 acryloyl groups, product name manufactured by Cytech, Inc.) and the like.

Among the above-mentioned (meth)acrylates, example of the tri-functional or higher polyfunctional (meth)acrylate include, for example, trimethylolpropane tri(meth)acrylate, EO-modified trimethylolpropane tri(meth)acrylate, pentaerythritol tri(meth)acrylate, EO-modified isocyanurate tri (meth)acrylate, pentaerythritol tetra(meth)acrylate, dipentaerythritol hexa(meth)acrylate, ditrimethylolpropane tetra (meth)acrylate, propoxy glycerin tri(meth)acrylate, caprolactone-modified trimethylolpropane tri(meth)acrylate, pentaerythritolethoxy tetra(meth)acrylate, and caprolactam modified dipentaerythritol hexa(meth)acrylate.

Among these, it is preferable that the other polymerizable compound include a monofunctional (meth)acrylate. In this case, the ink composition has low viscosity, the solubility of additives other than the photopolymerization initiator is excellent, and discharge stability is easily obtained. Because the toughness, heat resistance and chemical resistance of the ink coating film increase, it is preferable that the monofunctional (meth)acrylate and the bifunctional (meth)acrylate be used together.

It is preferable that the monofunctional (meth)acrylate include one or more types of skeleton selected from a group consisting of an aromatic skeleton, a saturated alicyclic skeleton, and an unsaturated alicyclic skeleton. It is possible to lower the viscosity of the ink composition by the other polymerizable compound being a monofunctional (meth)acrylate having the above skeletons.

Examples of the monofunctional (meth)acrylate having an aromatic skeleton include, for example, phenoxyethyl (meth) acrylate and 2-hydroxy-3-phenoxy propyl (meth)acrylate. Examples of the monofunctional (meth)acrylate having a saturate alicyclic skeleton include, for example, isobornyl (meth)acrylate, t-butylcyclohexyl (meth)acrylate, and dicyclophetanyl (meth)acrylate. Examples of the monofunctional (meth)acrylate having an unsaturated alicyclic skeleton include, for example, dicyclopentanyloxyethyl (meth)acrylate.

Among these, in order to be able to lower the viscosity and the odor, phenoxyethyl (meth)acrylate is preferable.

The content of the polymerizable compound other than the monomer A is preferable 10 mass % to 35 mass % with respect to the total mass (100 mass %) of the ink composition. If the content is within this range, the solubility of additives is excellent, and the toughness, heat resistance and chemical resistance of the ink coating film are excellent.

The polymerizable compound may be used either alone, or two or more types may be used together.

Photopolymerization Initiator

The photopolymerization initiator included in the ink composition of the embodiment is used in order to form printing ink that is present on the surface of a recording medium being cured through polymerization due to irradiation of ultraviolet light. By using ultraviolet light (UV) from among the radiation, it is possible for the safety to be superior and to suppress the cost of the irradiator.

The photopolymerization initiator contains an acylphosphine-based photopolymerization initiator and a thioxanthone-based photopolymerization initiator, as described above. In so doing, in addition to the curability of the ink being able to be superior, it is possible to prevent coloring of the initial cured film after printing.

In addition thereto, the total content of the acylphosphine-based photopolymerization initiator and the thioxanthone-based photopolymerization initiator, as described above, is 9 mass % to 14 mass % with respect to the total mass (100 mass %) of the ink composition, is preferably 10 mass % to 13 mass %, and more preferably 11 mass % to 13 mass %. In a case in which the total content of these in the ink is within this range, the curability and discharge stability of the ink are extremely superior. In particular, if the content is 9 mass % or more, because the viscosity becomes comparatively higher and it is possible to prevent an increase in mist that is a cause of staining of the image, the discharge stability of the ink is excellent.

Acylphosphine-Based Photopolymerization Initiator

The photopolymerization initiator in the embodiment includes an acylphosphine-based photopolymerization initiator, that is an acylphosphine oxide-based photopolymerization initiator (below referred to as "acylphosphine oxide"). In so doing, the curability of ink in particular is excellent, and it is possible to prevent coloring of the cured film at the initial stages after printing and coloring of the cured film after the passage of time (degree of initial coloring of the cured film is reduced).

Examples of the acylphosphine oxide include, but are not limited to, for example, 2,4,6-trimethyl benzoyl-diphenyl phosphine oxide, 2,4,6-triethyl benzoyl-diphenyl phosphine oxide, 2,4,6-triphenyl benzoyl-diphenyl phosphine oxide, bis (2,4,6-trimethylbenzoyl)-phenylphosphine oxide, and bis(2,6-dimthoxybenzoyl)-2,4,4,-trimethylpentylphosphineoxiide.

Examples of commercially available acylphosphine oxide-based photopolymerization initiators include, for example, DAROCUR TPO (2,4,6-trimethylbenzoyl-diphenylphosphineoxide), IRGACURE 819 (bis(2,4,6-trimethylbenzoyl)-phenylphosphine oxide), and CGI 403 (bis(2,6-dimthoxybenzoyl)-2,4,4,-trimethylpentylphosphineoxiide).

It is preferable that the acylphosphine oxide include monoacylphosphine oxide. In so doing, the curability of ink is excellent, along with curing sufficiently proceeding by sufficiently dissolving the photopolymerization initiator.

Examples of the monoacylphosphine oxide include, but are not particularly limited to, for example, 2,4,6-trimethylbenzoyl-diphenylphosphineoxide, 2,4,6-triethylbenzoyl-diphenylphosfineoxide, and 2,4,6-triphenylbenzoyl-diphenylphosphineoxide. Among these, 2,4,6-trimethylbenzoyl-diphenylphosphineoxide is preferable.

Examples of commercially available monoacylphosphine oxide include, for example, DAROCUR TPO (2,4,6-trimethylbenzoyl-diphenylphosphineoxide).

Because the photopolymerization initiator in the embodiment has excellent solubility in the polymerizable compound and curability of the ink coating film, and reduces the initial degree of coloring, it is preferable that the photopolymerization initiator be either monoacylphosphine oxide or a mixture of monoacylphosphine oxide and bis-acylphosphine oxide.

Examples of the bis-acylphosphine oxide include, but are not particularly limited to, for example, bis(2,4,6-trimethylbenzoyl)-phenylphosphine oxide, and bis(2,6-dimethoxybenzoyl)-2,4,4,-trimethylpentylphosphineoxide. Among these, bis(2,4,6-trimethylbenzoyl)-phenylphosphine oxide is preferable.

The content of the acylphosphine oxide is preferably 8 mass % to 11 mass % with respect to the total mass (100 mass %) of the ink composition, and more preferably in a range of 10 mass % to 11 mass %. If the content is with the above range, the curability of the ink is excellent, and the initial degree of coloring of the cured film is low.

Thioxanthone-Based Photopolymerization Initiator

The photopolymerization initiator in the embodiment includes a thioxanthone-based photopolymerization initiator (below, referred to as "thioxanthone"). In so doing, the curability of the ink is excellent, and the initial degree of coloring of the cured film is particularly low.

Among the thioxanthones, because the sensitizing effect to the acylphosphine oxide, solubility with respect to the polymerizable compound, and the safety are excellent, 2,4-diethylthioxanthone is preferable.

Examples of commercially available thioxanthones include, for example, KAYACURE DETX-S (2,4-diethylthioxanthone) (product name manufactured by Nippon Kayaku Co., Ltd.), ITX (manufactured by BASF), and Quantacure CTX (manufactured by Aceto Chemical).

The content of the thioxanthone is preferably 1 mass % to 3 mass % with respect to the total mass (100 mass %) of the ink composition, and more preferably in a range of 2 mass % to 3 mass %. If the content is with the above range, the curability of the ink is excellent, and the initial degree of coloring of the cured film becomes low.

Examples of the other photopolymerization initiator include, for example, Speedcure TPO (2,4,6-trimethylbenzoyl-diphenyl-phosphienxoide), and Speedcure DETX (2,4,-diethylthioxyxanthene-9-one) (all product names manufactured by Lambson).

Coloring Material

The ink composition of the embodiment may further include a coloring material. The coloring material may use a pigment.

Pigment

In the embodiment, it is possible to improve the light resistance of the ink composition by using a pigment as the coloring material. The pigment may use either of an inorganic pigment or an organic pigment.

Carbon blacks (C.I. Pigment Black 7) such as furnace black, lamp black, acetylene black, and channel black, iron oxide, and titanium oxide may be used as the inorganic pigment.

Examples of the organic pigment include, azo pigments such as insoluble azo pigments, condensed azo pigments, azo lake, and chelate azo pigments; polycyclic pigments such as phthalocyanine pigments, perylene and perynone pigments, anthraquinone pigments, quinacridone pigments, dioxane pigments, thioindigo pigments, isoindolinone pigments, and quinophthalone pigments; and chelate dyes (for example, a basic dye-type chelate, an acidic dye-type chelate, or the like), lake dyes (for example, a basic dye-type lake, an acid dye-type lake), nitro pigments, nitroso pigments, aniline black, and daylight fluorescent pigments.

In more detail, examples of the carbon black used in the black ink include No. 2300, No. 900, MCF 88, No. 33, No. 40, No. 45, No. 52, MA7, MA8, MA100, and No. 2200B (product names manufactured by Mitsubishi Chemical Corporation); Raven 5750, Raven 5250, Raven 5000, Raven 3500, Raven 1255, and Raven 700 (product names manufactured by Carbon Columbia); Regal 400R, Regal 330R, Regal 660R, Mogul L, Monarch 700, Monarch 800, Monarch 880, Monarch 900, Monarch 1000, Monarch 1100, Monarch 1300, and Monarch 1400 (product names manufactured by CABOT JAPAN K.K.); Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 (product names manufactured by Degussa).

Examples of the pigment used in the white ink include C.I. Pigment White 6, 18, and 21. A compound containing usable metal atoms may also be used as the white pigment, and examples thereof include, for example, a metal oxide compound, barium sulfate and calcium carbonate used as a white pigment in the related art. Examples of the metal oxide include, but are not particularly limited to, for example, titanium dioxide, zinc oxide, silica, alumina, and magnesium oxide.

Examples of the pigment used in the yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, and 180.

Examples of the pigment used in the magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, and 245, or C.I. Pigment Violet 19, 23, 32, 33, 36, 38, 43, and 50.

Examples of the pigment used in the cyan ink include C.I. Pigment Blue 1, 2, 3, 15, 15:1, 15:2, 15:3, 15:34, 15:4, 16, 18, 22, 25, 60, 65, and 66 or C.I. Vat Blue 4 and 60.

Examples of pigments other than magenta, cyan and yellow include, for example, C.I. Pigment Green 7 and 10, or C.I. Pigment Brown 3, 5, 25, and 26, or C.I. Pigment Orange 1, 2, 5, 7, 13, 14, 15, 16, 24, 34, 36, 38, 40, 43, and 63.

The pigments may be used alone or a mixture of two or more types may be used.

In cases in which the above pigments are used, it is preferable that the average particle diameter thereof be 2 μm or less, and 30 to 300 nm is more preferable. If the average particle diameter is within the above range, it is possible to form an image with excellent image quality along with the reliability, such ejection stability and dispersion stability in the ink composition, being much superior. The average particle diameter in the present specification is measured by a dynamic light scattering method.

In order to have satisfactory chromagenicity, and be able to reduce curing defects in the ink coating film due to light absorption by the coloring material itself, the content of the coloring material is preferable in a range of 1.5 mass % to 6 mass % with respect to the total content rate (100 mass %) of the ink composition in a case of the CMYK colors, and a range of 15 mass % to 30 mass % is preferable in a case the W color.

Dispersant

In a case in which the ink composition of the embodiment includes a pigment, the composition may further include a dispersant in order to further improve the pigment dispersibility. Examples of the dispersant include, but are not particularly limited to, dispersants commonly used in the preparation of pigment dispersion liquids such as molecular dispersants. Specific examples thereof include one or more types of polyoxyalkylene polyalkylene polyamine, vinylbased polymers and copolymers, acrylic-based polymers and copolymers, polyester, polyamide, polyimide, polyurethane, amine-based polymers, silicon-containing polymers, sulfur-containing polymers, fluorine-containing polymers, and epoxy resins and the like as a main component.

Examples of commercially available high molecular weight dispersants include the AJISPER series (product name) by Ajinomoto Fine-Techno Co., Inc, the Solsperse series (Solsperse 36000, Solsperse 32000 or the like, product names) available from Lubrizol Corporation, the Disperbyk series (product name) by BYK Japan K.K., and the Disparlon series (product name) by Kusumoto Chemicals, Ltd.

Leveling Agent

The ink composition of the embodiment may further include a leveling agent (surfactant) in order to improve the wetting properties with the printing base material. Although there is no particular limitation on the leveling agent; however, for example, polyester modified silicone and polyether-modified silicone may be used as a silicone-based surfactant, and polyether-modified polydimethylsiloxane and polyether-modified polydimethylsiloxane are particularly preferable. More specifically, examples include BYK-347, BYK-348, BYK-UV 3500, 3510, 3530, and 3570 (product names manufactured by BYK Japan K.K.).

Polymerization-Inhibitor

The ink composition of the embodiment may further include a polymerization-inhibitor in order for the storage stability of the ink composition to be improved. Although there is no particular limitation on the polymerization-inhibitor, for example, IRGASTAB UV 10 and UV 22 (product names manufactured by BASF), and hydroquinone monomethyl ether (MEHQ, product name manufactured by KANTO CHEMICAL CO., INC.) may be used.

Other Additives

The ink composition of the embodiment may include other additives (components) than the additives listed above. Although there is no particular limitation on such components, polymerization accelerators, penetration enhancers and wetting agents (moisturizing agents) known in the related art and other additives are possible. Examples of the other additives include, for example, fixatives, anti-fungal agents, preservatives, antioxidants, ultraviolet light absorbing agents, chelating agents, pH adjusters, and thickening agents known in the related art.

Physical Properties of Ink Composition

The ink composition of the embodiment preferably has a viscosity of 15·mPa s or lower at 20° C., and 9 mPa·s to 14 mPa·s is more preferable. If the viscosity is within these ranges, the solubility of the other additives than the polymerization initiator is excellent and it is easy to obtain discharge stability. The viscosity in the specification is a value measured using an MCR 300 rheometer manufactured by DKSH Japan K.K. The ink composition of the embodiment is curable through irradiation of ultraviolet light with an emission peak wavelength in a range of 365 to 405 nm.

As above, a UV ink composition ordinarily employed has been described; however, the UV ink composition used in the embodiment will be described. FIG. 2 is a diagram showing the composition of each color of UV ink in the embodiment. As shown in FIG. 2, each color of UV ink contains VEEA (bifunctional polymer), PEA (monofunctional monomer) and DPGDA (bifunctional monomer) as the polymerizable compound. Furthermore, only the cyan and black UV inks contain A-DPH (heptafunctional monomer) as the tri-functional or higher polyfunctional monomer. In the description below, the tri-functional or higher polyfunctional monomer is referred to as a "polyfunctional monomer". The polyfunctional monomer being contained in the cyan UV ink is for viscosity adjustment, and the polyfunctional monomer not being included in the black UV ink is as a coagulating countermeasure. Below, a detailed description thereof will be provided.

The cyan UV ink has a lower viscosity compared to other colors of UV ink. Therefore, there are cases in which the driving waveform for driving the print head 36*a* that discharges the cyan UV ink is greatly different compared to the driving waveform for driving the print heads 36*b* to 36*d* that discharge other colors of UV ink. Thereby, it is necessary to change the characteristics of the driving wave form for the print head 36*a* only. In order for the driving wave forms to be shared with the print heads 36*a* to 36*d*, the cyan UV ink is made to include a polyfunctional monomer, and the viscosity of the cyan UV ink is set to the same extent as the viscosity of the other UV inks.

Meanwhile, the black UV ink includes a polyfunctional monomer in order to respond to the problem of wrinkling (coagulation) occurring in the surface of the ink during curing. Here, the mechanism by which wrinkling occurs will be described. The irradiators 37*a* to 37*d* used in the embodiment irradiate ultraviolet rays having a peak wavelength in the vicinity of 395 nm. Accordingly, the UV ink discharged from each of the print heads 36*a* to 36*d* changes in the curing properties thereof according to whether or not ultraviolet rays having such a peak wave length are easily absorbed. In the embodiment, the pigments included in the black and yellow UV inks comparatively easily absorbs ultraviolet rays having the peak wavelength, whereas the pigments included cyan and magenta UV inks absorb ultraviolet rays having the peak wavelength with relative difficulty.

In a case in which provisional curing is performed by irradiating the black and yellow UV inks that easily absorb ultraviolet rays with ultraviolet rays, the surface portion of the ink is cured; however, the ultraviolet rays do not easily reach the inner portions of the ink because the ultraviolet rays are absorbed by the pigment. As a result, only the surface of the ink is cured and the inner portions thereof easily become gel-like and have fluidity. In this state, when main curing is further performed, the gel-like ink at the inner portions is cured and contracted, and a problem arises in which wrinkling occurs in the already cured surface of the ink. By suppressing the fluidity of the inner portions of the ink by the action of the polyfunctional monomer in the black UV ink, the occurrence of wrinkling in the ink surface is suppressed.

Naturally, the occurrence of wrinkling for the yellow UV ink is suppressed by a separate method from the black UV ink. That is, as shown in FIG. 1, the irradiator 37*d* provided on the downstream side of the print head 36*d* performs main curing by irradiating strong ultraviolet rays and the print head 36*d* that discharges the yellow UV ink is arranged further to the downstream side in the transport direction Ds than the other print heads 36*a* to 36*c*. By doing so, because main curing is performed straight away without provisional curing with respect to the yellow UV ink, the surface and the inner portions of the ink are cured together, it is possible to avoid the problem of the occurrence of wrinkling in the surface of the ink.

In light of such a situation as above, in the embodiment, the polyfunctional monomer (A-DPH) is included with respect to the black and yellow UV inks only, and the polyfunctional monomer is not included with respect to the magenta and yellow UV inks. The polyfunctional monomer has more bonds compared to a monofunctional monomer and a bifunctional monomer, and the bonding force when cured is greater than that of the monofunctional monomer and the bifunctional monomer. Therefore, in a case in which each color of UV ink is cured on the nozzle forming surface 362 of each of the print heads 36*a* to 36*d*, as the content rate of the polyfunctional monomer increase, the ink becomes more difficult to be removed from each nozzle forming surface 362. Such a tendency is clearly seen particularly in cases in which wiping in which a cleaning solution is used is performed with respect to the nozzle forming surface 362 of each print head 36*a* to 36*d*, as shown in FIG. 3.

FIG. 3 is a diagram showing the removal effect of each color of UV ink due to wiping using a cleaning solution. Here, the experiments were performed as follows. That is, along with each color of UV ink having the composition shown in FIG. 2 and being discharged toward the sheet S transported in the transport direction Ds from the print head 36, a process of irradiating the landed UV on the sheet S with ultraviolet rays was performed for 66 continuous minutes using the irradiator 37 arranged further to the downstream side in the transport direction Ds of the sheet S than the print head 36. Thereafter, wiping was performed with respect to the nozzle forming surface 362 using EDGAC as the cleaning solution, and the UV ink attached to the nozzle forming surface 362 was removed. Thereafter, a predetermined test pattern was printed by discharging UV ink onto the sheet S from the print head 36 after wiping was performed, and the discharge state of the ink from the print head 36 was verified by verifying the printed matter thereof. The experiment was separately performed for each color of UV ink, and the experimental conditions such as the positional relationships of the print head 36 and the irradiator 37, the irradiation intensity of the irradiator 37 and the transport speed of the sheet S were common to each type color of UV ink. The accumulated light amount due to the irradiator 37 is of an extent for each color of UV ink to be provisionally cured, and the accumulated light amount are performed with four patterns (0, 5, 10, 15) (unit: $mJ/cm^2$).

According to FIG. 3, it can be understood that the discharge state of the black UV ink easily becomes the worst, and next, the discharge state of the cyan UV ink easily worsens. In this way, the discharge state of the black and cyan UV inks easily worsening compared to that of the other colors of UV ink is thought to be caused by the black and cyan UV inks including the polyfunctional monomer. That is, as described above, as the content rate of the polyfunctional monomer in the UV ink increases, the more difficult it is to remove the ink in a case in which the ink is attached and cured to each nozzle forming surface 362. Therefore, for the black and cyan UV inks, it is difficult to remove the ink from the nozzle forming surface 362 even if wiping is performed, and the ink remaining on the nozzle forming surface 362 is thought to worsen the discharge state from the nozzle 361.

The reason why the black UV ink is more difficult to remove, regardless of whether the content rate of the polyfunctional monomer (A-DPH) in the black UV ink and the cyan UV ink is the same 8%, is presumed to be because of the difference in solubility with respect to the cleaning solution (EDGAC) due to the difference pigments. That is, it is presumed that because the EDGAC is an organic-based cleaning solution, the cyan UV ink that includes the same organic-based pigment (Pigment Blue) is easier to dissolve in the cleaning solution, and the black UV ink that includes an inorganic-based pigment (carbon black) is more difficult to dissolve in the cleaning solution.

Figure 4A:
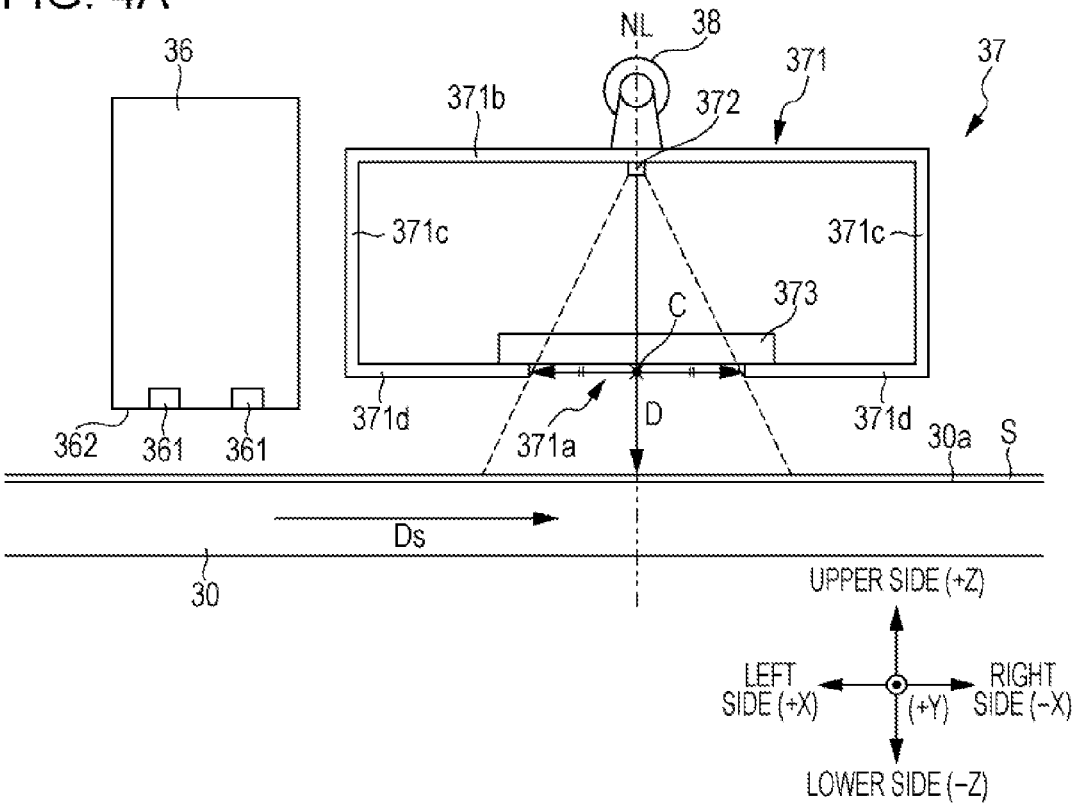
FIGS. 4A and 4B are diagrams schematically showing an example of a configuration of an irradiator.
Figure 4B:
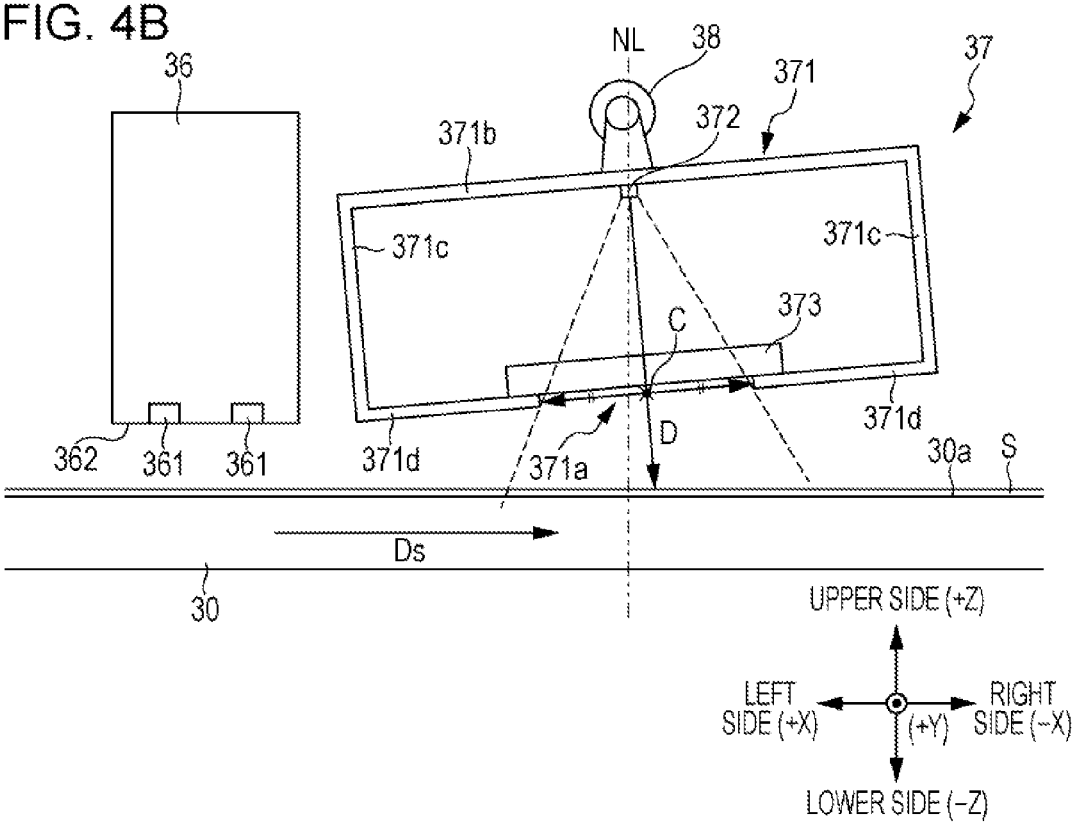

Next, the irradiators 37*a* to 37*d* will be described in detail. FIGS. 4A and 4B are diagrams schematically showing examples of the configuration of the irradiator. The print heads 36*a* to 36*d* each have the same configuration, and, the irradiators 37*a* to 37*c* each have the same configuration. In FIGS. 4A and 4B, one of any of the print heads 36*a* to 36*c* is represented by the print head 36 without distinguishing between the print heads 36*a* to 36*c*, and any of the irradiators 37*a* to 37*c* provided neighboring with respect to the print head 36 to the downstream side in the transport direction Ds will be described as the irradiator 37. The irradiator 37*d* is configured to emit a greater accumulated light amount of ultraviolet rays than the irradiator 37*a* to 37*c*, and for the light source used in irradiator, the same light source as the irradiators 37*a* to 37*c* may be arranged in greater numbers than the irradiators 37*a* to 37*c*, or different light source to the irradiator 37*a* to 37*c* may be used. FIG. 4A shows a case in which the opening 371*a* formed in the irradiator 37 is parallel to the sheet S supported by the planar support surface 30*a* of the platen 30, and FIG. 4B shows a case in which the opening 371*a* formed in the irradiator 37 is inclined with respect to the sheet S supported by the planar support surface 30*a* of the platen 30. The term parallel herein indicates not only perfectly parallel, but also includes appearing substantially parallel.

The irradiator 37 is configured to include a housing 371 in which an opening 371*a* is provided opposing the sheet S, a light source 372 accommodated in the housing 371 on the opposite side of the sheet S with respect to the opening 371*a*, and a glass member 373 that covers the opening 371*a*. The housing 371 includes a ceiling portion 371*b*, a pair of wall portions 371*c* extending downwards towards the sheet S from both the left and right sides of the ceiling portion 371*b*, and a pair of bottom portions 371*d* that protrude towards the opening 371*a* from the lower end of each wall portion 371*c*. That is, the pair of bottom portions 371*d* is provided in a state of being projected from the lower end of the inner wall surface of each wall portion 371*c*, and the opening 371*a* is regulated by the front ends of the pair of bottom portions 371*d*.

The light source 372 is provided on the ceiling portion 371*b* of the housing 371, and irradiates ultraviolet rays for curing the UV ink, and more specifically, ultraviolet rays having a peak wavelength in the vicinity of 395 nm as described above. Although a light emitting diode (LED), for example, may be employed as the light source 372, it is naturally possible to employ other light sources. The glass member 373 covers the opening 371*a* in a state of being supported by the pair of bottom portions 371*d* provided on both the left and right sides of the opening 371*a*, and allows ultraviolet rays emitted from the light source 372 to pass therethrough. Naturally, the irradiator 37 is connected to the rotation mechanism 38 having a rotary shaft extending in the Y-axis direction, and is configured to be rotated about the Y-axis via the rotation mechanism 38.

In irradiator 37 configured as described above, the ultraviolet rays irradiated from the light source 372 reach the sheet S by passing through the opening 371*a*. At this time, as shown in FIG. 4A, in a case in which the direction D from the light source 372 towards the center C in the transport direction Ds of the opening 371*a* substantially matches the normal line NL (perpendicular line descending from the light source 372 to the sheet S) that is orthogonal to the sheet S supported by the support surface 30*a* of the platen 30, the ultraviolet rays irradiated from the irradiator 37 to the sheet S do not have a particular directionality in the transport direction Ds (in other words, have an optical axis along the normal line NL, and have directionality in the direction of the normal line NL). That is, the ultraviolet rays the sheet S is irradiated with by the irradiator 37 are irradiated substantially uniformly on both sides in the transport direction Ds with respect to the center C of the opening 371*a*. In a case in which the opening 371*a* is not formed parallel to the sheet S (or the platen 30), the center C in the transport direction Ds of the opening 371*a* may be read as the center in the transport direction Ds of the irradiation range formed on the sheet S (or the platen 30) by the ultraviolet rays irradiated from the light source 372. The term optical axis here indicates a straight line by which the substantial center in the transport direction Ds of the irradiation range formed on the sheet S (or the platen 30) by the ultraviolet rays irradiated from the light source 372 and the light source 372 are joined. Alternatively, in a case of a plurality of light sources 372, the term optical axis indicates a straight line by which the substantial center in the transport direction Ds of the irradiation range formed on the sheet S (or the platen 30) by the ultraviolet rays irradiated from the irradiator 37 and the substantial center in the transport direction Ds of the irradiation range formed on a virtual plane parallel to the sheet S and positioned between the opening 371*a* and the sheet S are joined. Furthermore, in a case in which the support surface of the platen is not flat, such as the rotary drum described later, the term optical axis indicates a straight line by which the substantial center in the transport direction Ds of the irradiation range formed by the ultraviolet rays irradiated from the irradiator 37 in a first virtual platen that contacts the intersection of the perpendicular line descending from the position of light source 372 to the platen and the substantial center in the transport direction Ds of the irradiation range formed by a second virtual plane parallel to the first virtual plane and positioned between the opening 371*a* and the first virtual plane. In a case of a plurality of light sources, it is possible to set the center of the light amount distribution or the like to the position of the light source.

Meanwhile, for example, FIG. 4B shows a state in which the irradiator 37 is rotated counter-clockwise with respect to the rotary shaft extending in the Y-axis direction in the drawing by the rotation mechanism 38. In the description below, for example, "rotates counter-clockwise with respect to the rotary shaft extending in the Y-axis direction in the drawing" is simply denoted by "rotates counter-clockwise in the drawing." At this time, the direction D from the light source 372 to the center C of the opening 371*a* becomes a direction (direction having a component toward the downstream side in the transport direction Ds) receding from the print head 36 in the transport direction Ds. In other words, the direction D is inclined towards the downstream side in the transport direction Ds with respect to the normal line NL orthogonal to the sheet S supported by the support surface 30*a* of the platen 30 and the ultraviolet rays emitted from the irradiator 37 to the sheet S have directionality in a direction (downstream side in the transport direction Ds) receding from the print head 36 in the transport direction Ds (in other words, the optical axis is inclined with respect to the normal line NL in a direction (downstream side in the transport direction Ds) receding from the print head 36). As a result, more of the ultraviolet rays travel in a direction receding from the print head 36 in the transport direction Ds, and it is possible to suppress the incidence of ultraviolet rays on the nozzle forming surface 362 of the print head 36. In this case, the direction D takes the print head (not shown in FIGS. 4A and 4B) provided further to the downstream side in the transport direction Ds from the irradiator 37 as a reference and refers to the direction approaching the print head in the transport direction Ds.

In this way, it is possible to change the direction of the directionality of the ultraviolet rays irradiated towards the sheet S from the irradiator 37 by inclining the direction D from the light source 372 towards the center C in the transport direction Ds of the opening 371*a* with respect to the normal line NL orthogonal to the sheet S. Below, the description will be continued in which the direction D from the light source 372 towards the center C in the transport direction Ds of the opening 371*a* shows the direction of the directionality of the ultraviolet rays irradiated towards the sheet S from the irradiator 37. As above, in the embodiment, the position in the transport direction Ds of the opening 371*a* with respect to the light source 372 is changed and it is possible to regulate the direction D of the directionality of the ultraviolet rays irradiated by the irradiator 37 by the irradiator 37 inclining by being rotated about the Y-axis direction orthogonal to the transport direction Ds.

In FIGS. 4A and 4B, although only one light source 372 is provided in the transport direction Ds, even in a case in which a plurality of light sources 372 is provided in the transport direction Ds, it is possible to similarly capture the direction of the directionality. That is, in a case in which a plurality of light sources 372 is provided in the transport direction Ds, it is possible to set the geometric center in the transport direction Ds of the plurality of light sources 372, or the center of the light amount distribution or the like in the transport direction Ds of the light irradiated by the plurality of light sources 372 to the origin of the direction D of the directionality. Also in a case in which the light sources 372 have a spread too large to be ignored in the transport direction Ds, it is similarly possible to set the geometric center in the transport direction Ds of the light source 372, or the center of the light amount distribution or the like in the transport direction Ds of the light emitted by the light source 372 to the origin of direction D of the directionality. The direction of the directivity may be defined by a separate method. That is, in any way of defining, differences in the light amount of the ultraviolet rays towards the upstream side and the ultraviolet rays towards the downstream side in the transport direction Ds do not occur by changing the direction of the directionality.

Figure 5:
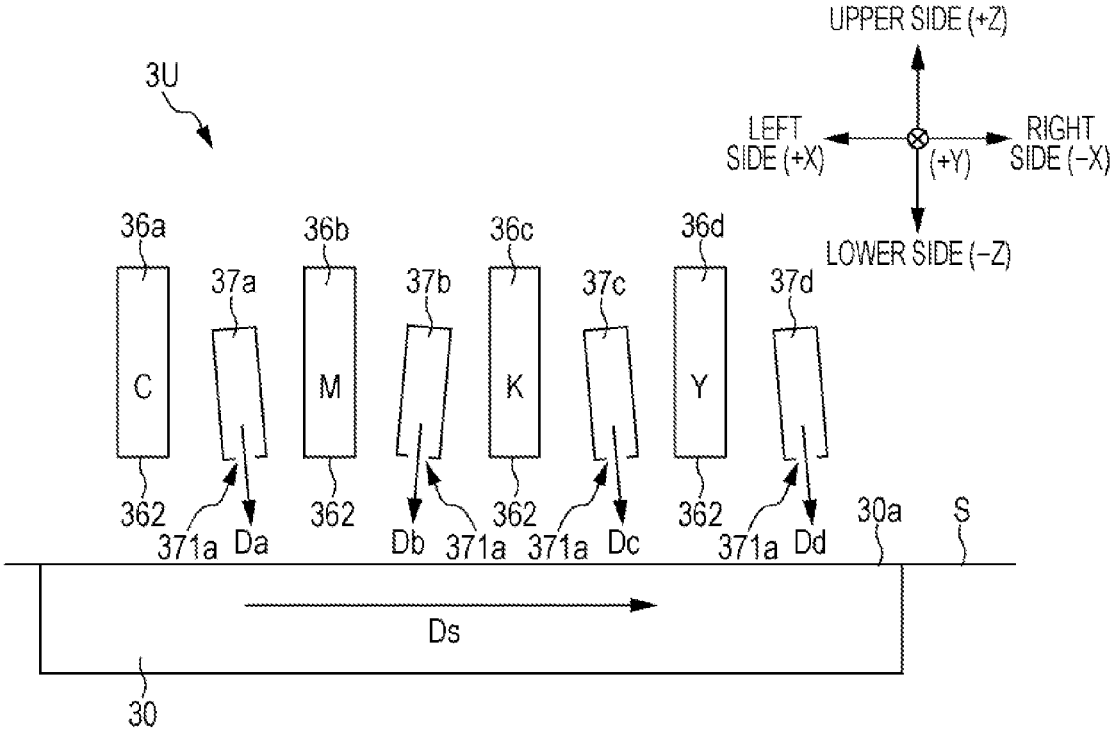
FIG. 5 is a front view schematically showing a favorable arrangement form of the irradiator.

Next, the arrangement form of the irradiators 37*a* to 37*d* for effectively suppressing the UV ink attached to the nozzle forming surface 362 of the print heads 36*a* to 36*d* from being cured through the incidence of ultraviolet rays. FIG. 5 is a front view schematically showing a favorable arrangement mode of the irradiator. In the following description, for example, the print head 36*a* that discharges the cyan UV ink is simply denoted by "cyan print head 36*a*".

As described above, in the embodiment, the cyan and the black UV inks contain the polyfunctional monomer (content rate 8%), and in a case where cured, the removal thereof is comparatively difficult, whereas the magenta and the yellow UV inks do not contain the polyfunctional monomer (content rate 0%), and the removal thereof is comparatively easy even if cured. The arrangement order in the transport direction Ds of the print head 36*a* to 36*d* as set to alternate large and small polyfunctional monomer content rates from the upstream side towards the downstream side. More specifically, the content rate becomes large (cyan), small (magenta), large (black), and small (yellow) in that order from the upstream side. The direction D (Da to Dc) of the directionality of the ultraviolet rays irradiated from the irradiators 37*a* to 37*c* arranged between the respective print heads 36*a* to 36*d* is set to a direction receding from the print heads 36*a* and 36*c* that discharge UV ink with a higher content rate of the polyfunctional monomer in the transport direction Ds.

More specifically, the irradiator 37*a* arranged between the cyan print head 36*a* and the magenta print head 36*b* is arranged in a state of being rotated by, for example, only 5 degrees counter-clockwise in the drawing by the rotation mechanism 38. As a result, the irradiator 37*a* irradiates ultraviolet rays having directionality in the direction Da receding from the print head 36*a* in the transport direction Ds towards the sheet S. The irradiator 37*b* arranged between the magenta print head 36*b* and the black print head 36*c* is arranged in a state of being rotated by, for example, only 5 degrees clockwise in the drawing by the rotation mechanism 38. As a result, the irradiator 37*b* irradiates ultraviolet rays having directionality in the direction Db receding from the print head 36*c* in the transport direction Ds towards the sheet S. The irradiator 37*c* arranged between the black print head 36*c* and the yellow print head 36*d* is arranged in a state of being rotated by, for example, only 5 degrees counter-clockwise in the drawing by the rotation mechanism 38. As a result, the irradiator 37*c* irradiates ultraviolet rays having directionality in the direction Dc receding from the print head 36*c* in the transport direction Ds towards the sheet S.

For example, by setting the direction Da of the directionality of the ultraviolet rays irradiated from the irradiator 37*a* to a direction receding from the cyan print head 36*a* with a higher content rate of polyfunctional monomer, in other words, a direction approaching the magenta print head 36*b* with a lower content rate of the polyfunctional monomer, the following results are obtained. That is, it is possible to suppress ultraviolet rays being incident on the nozzle forming surface 362 of the cyan print head 36*a*, and to suppress curing of the cyan UV ink that is comparatively difficult to remove during curing on the nozzle forming surface 362. Meanwhile, in this case, although the ultraviolet rays incident on the nozzle forming surface 362 of the magenta print heads 36*b* are assumed to increase (in the embodiment, the amount (accumulated light amount in the nozzle forming surface 362) of ultraviolet rays incident on the nozzle forming surface 362 of the print head 36*b* that discharges magenta UV ink is greater than the other print heads 36*a*, 36*b* and 36*d*), because removal of the magenta UV ink is comparatively easy during curing at the outset, the influence of the increase in the incidence amount of the ultraviolet rays is small. Accordingly, even with respect to either of the print heads 36*a* or 36*b* arranged on both sides of the irradiator 37*a*, an effect is exhibited of being able to effectively suppress the problem of the UV ink attached to the nozzle forming surface 362 being cured by the incidence of ultraviolet rays.

A similar effect to above is exhibited by setting the direction Db of the directionality of the ultraviolet rays irradiated from the irradiator 37*b* to a direction receding from the black print head 36*c* with the higher content rate of the polyfunctional monomer, in other words, to a direction approaching the magenta print head 36*b* with the lower content rate of the polyfunctional monomer in the transport direction Ds. Furthermore, a similar effect to above is exhibited by setting the direction Dc of the directionality of the ultraviolet rays irradiated from the irradiator 37*c* to a direction receding from the black print head 36*c* with the larger content rate of the polyfunctional monomer in the transport direction Ds, in other words, to a direction approaching the yellow print head 36*d* with the lower content rate of the polyfunctional monomer.

Furthermore, in the embodiment, the irradiator 37*d* arranged further to the downstream side in the transport direction Ds than the yellow print head 36*d* is arranged in a state of being rotated by, for example, only 5 degrees counter-clockwise in the drawing by the rotation mechanism 38. As a result, since the irradiator 37*d* irradiates ultraviolet rays having directionality in the direction Dd receding from the print head 36*d* in the transport direction Ds towards the sheet S, it is possible to suppress the incidence of ultraviolet rays on the nozzle forming surface 362 of the yellow print head 36*d*. However, by setting the direction Dd of the directionality of the ultraviolet rays irradiated from the irradiator 37*d* to the direction perpendicular with respect to the transport direction Ds, it is possible to suppress the incidence of ultraviolet rays on the nozzle forming surface 362 of the print head 36*d*. It is possible to appropriately change the angle of rotation of each irradiator 37*a* to 37*d* to other than 5 degrees, and the angle of rotation may be different for each irradiator 37*a* to 37*d*.

In the embodiment, the cyan print head 36*a* is arranged further to the upstream side in the transport direction Ds than the magenta print head 36*b*, and the black print head 36*c* is arranged further to the downstream side in the transport direction Ds than the magenta print head 36*b*. However, since the content rate of the polyfunctional monomer in the cyan UV ink and the black UV ink stays greater than the magenta UV ink, it is possible to swap the cyan print head 36*a* and the black print head 36*c*. However, as already described, there is a situation in which the cyan UV ink is more difficult to coagulate than the black UV ink by the relationship with the peak wavelength of the irradiated ultraviolet rays. Therefore, as in the embodiment, if the black print head 36*c* is arranged further to the downstream side, the number of times ultraviolet rays are irradiated with respect to the black UV ink discharged onto the sheet S is reduced compared to a case in which the black print head 36*c* is arranged further to the upstream side, there is an advantage in that it is possible to suppress the degree to which coagulation occurs in the black UV ink and to perform favorable image recording.

In the removal of the UV ink attached to the nozzle forming surface 362 of each print head 36*a* to 36*d*, although it is possible for a worker to perform the wiping with a manual procedure, it is also possible to perform wiping with respect to the nozzle forming surface 362 with the maintenance unit 50 (refer to FIG. 1) using EDGAC as the cleaning solution. The solubility with respect to the EDGAC of each color of UV ink cured by ultraviolet rays has a tendency towards increasing for the UV ink as the content rate of the polyfunctional monomer decreases. In the embodiment, from the print heads 36 provided on both sides of any one irradiator 37 of the irradiators 37*a* to 37*c*, because comparatively more ultraviolet rays are incident on the print head 36 that discharges the UV ink with the lower content rate of the polyfunctional monomer, there is concern of the UV ink attached to the print head 36 becoming easily cured. However, since the UV ink with the lower content rate of polyfunctional monomer cured due to ultraviolet rays has greater solubility with respect to the cleaning solution, it is possible to cause the UV ink attached to the nozzle forming surface 362 of the print head 36 to be effectively dissolved, and possible to more reliably perform removal thereof.

As described above, according to embodiment, the first print head and the second print head are provided at different positions in the transport direction Ds of the sheet S, and configured as follows in a case in which an irradiator is provided between the first print head and the second print head. That is, the ultraviolet rays having directionality in a direction receding in the transport direction Ds from the print head that discharges the UV ink with the higher content rate of the polyfunctional monomer, in other words, the UV ink for which removal during curing is more difficult are irradiated from the irradiator. As a result, because the incidence of ultraviolet rays is suppressed with respect to the nozzle forming surface 362 of the print head that discharges the ink with the greater difficulty of removal during curing, the occurrence of problems caused by the incidence of ultraviolet rays on the nozzle forming surface 362 are effectively suppressed. Meanwhile, in a case irradiating ultraviolet rays having such directionality, comparatively more ultraviolet rays are incident on the nozzle forming surface 362 of the print head that discharges the UV ink with the lower content rate of polyfunctional monomer, that is, the UV ink with the greater ease of removal during curing. However, because the print head discharges a UV ink that is comparatively easy to remove during curing, the occurrence of problems caused by the incidence of ultraviolet rays on the nozzle forming surface 362 is effectively suppressed by appropriately performing maintenance, such as wiping. In this way, in the embodiment, it is possible to effectively suppress the problem of UV ink attached to the nozzle forming surface 362 curing due to the incidence of ultraviolet rays with respect to either of the print heads arranged on both sides of the irradiator.

In the embodiment, each of the combination of the print head 36*a*, the print head 36*b* and the irradiator 37*a*, the combination of the print head 36*b*, the print head 36*c* and the irradiator 37*b*, or the combination of the print head 36*c*, the print head 36*d* and the irradiator 37*c* correspond to the combination of "the first print head", "the second print head", and "the first irradiator" of the first aspect of the invention. In the embodiment, the combination of the print head 36*a*, the print head 36*b*, the print head 36*c*, and the irradiator 37*a* and the irradiator 37*b* corresponds to the combination of "the first print head", "the second print head", "the third print head", "the first irradiator" and "the second irradiator" according to the third aspect of the invention. In the embodiment, the combination of the print head 36*b*, the print head 36*c*, the print head 36*d*, and the irradiator 37*b* and the irradiator 37*c* corresponds to the combination of "the first print head", "the second print head", "the third print head", "the first irradiator" and "the second irradiator" according to the sixth aspect of the invention. In the embodiment, the combination of the print head 36*a*, the print head 36*b*, the print head 36*c*, the print head 36*d*, the irradiator 37*a*, the irradiator 37*b*, and the irradiator 37*c* corresponds to the combination of "the first print head", "the second print head", "the third print head", "the fourth print head", "the first irradiator", "the second irradiator", and "the third irradiator" according to the ninth aspect of the invention, and the irradiator 37*d* corresponds to "the fourth irradiator" according to the eleventh aspect of the invention. In the embodiment, the front driving roller 31 and the rear driving roller 32 correspond to "the transport unit" of the invention, and the maintenance unit 50 corresponds to "the maintenance mechanism" of the invention.

The invention is not limited to the above embodiments, and the elements of the embodiments may be combined or various modifications made as long as they do not depart from the gist thereof. In the description below, description of configuration common to the above embodiments will not be made; however, that the same effects are exhibited by including the configuration shared with the embodiments goes without saying.

Figure 6:
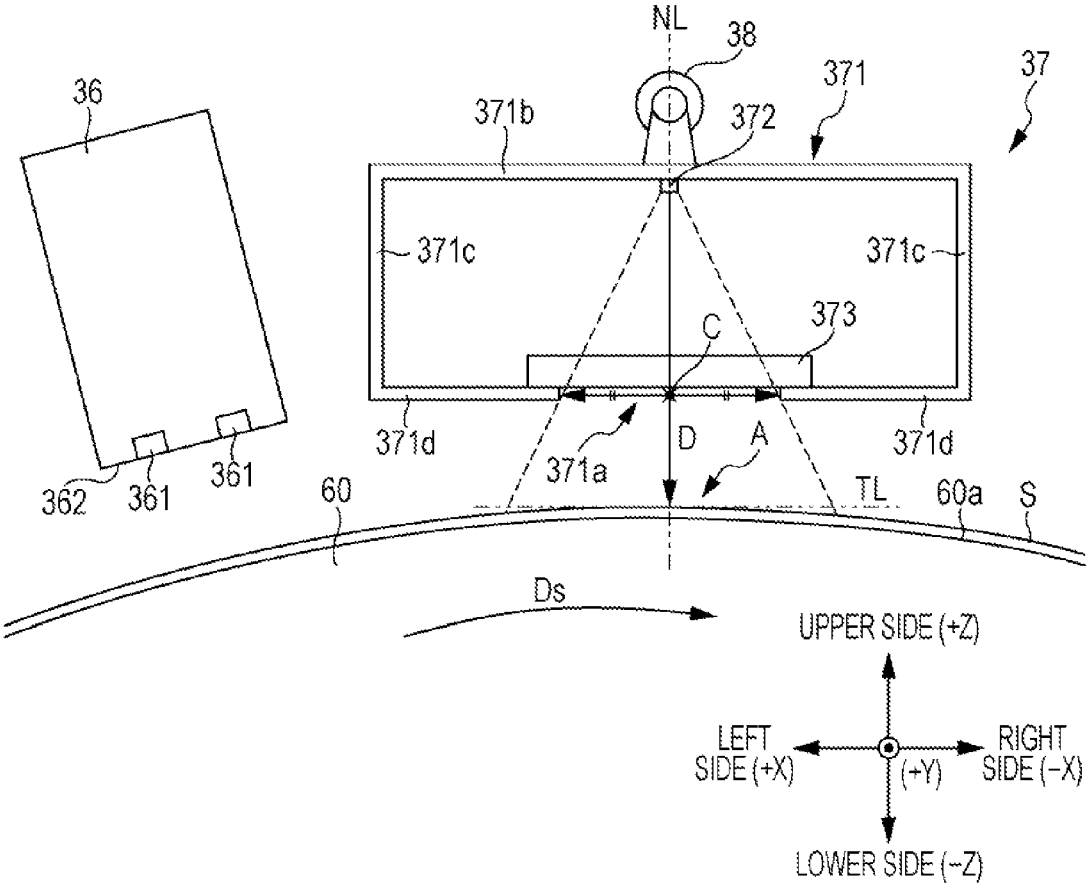
FIG. 6 is a diagram schematically showing a form that supports a sheet with a rotary drum.

In the embodiment, image recording is performed by an image recording unit 3U in a state in which the sheet S is supported by a planar support surface 30*a* of the platen 30. However, it is possible to support the sheet S in another support form. For example, FIG. 6 is a diagram schematically showing a form that supports a sheet with a rotary drum. The rotary drum 60 is configured as a cylinder having a rotary axis (not shown in the drawings) orthogonal to the transport direction Ds, and the support surface (outer peripheral surface) 60*a* supports the sheet S. Also in this case, similarly to the embodiments, it is possible to define the direction D from the light source 372 towards the center C in the transport direction Ds of the opening 371*a* as the directionality of the ultraviolet rays irradiated from the irradiator 37. As shown in FIG. 6, when the direction D of the directionality substantially matches the normal line NL orthogonal with respect to a contact line TL at the intersection of the direction D of the directionality and the sheet S, the ultraviolet rays irradiated towards the sheet S from the irradiator 37 does not have a particular directionality in the transport direction Ds. Meanwhile, similarly to the embodiments, it is possible to impart directionality in the transport direction Ds by arranging the irradiator 37 in a state of being appropriately rotated around the Y-axis by the rotation mechanism 38.

Figure 7:
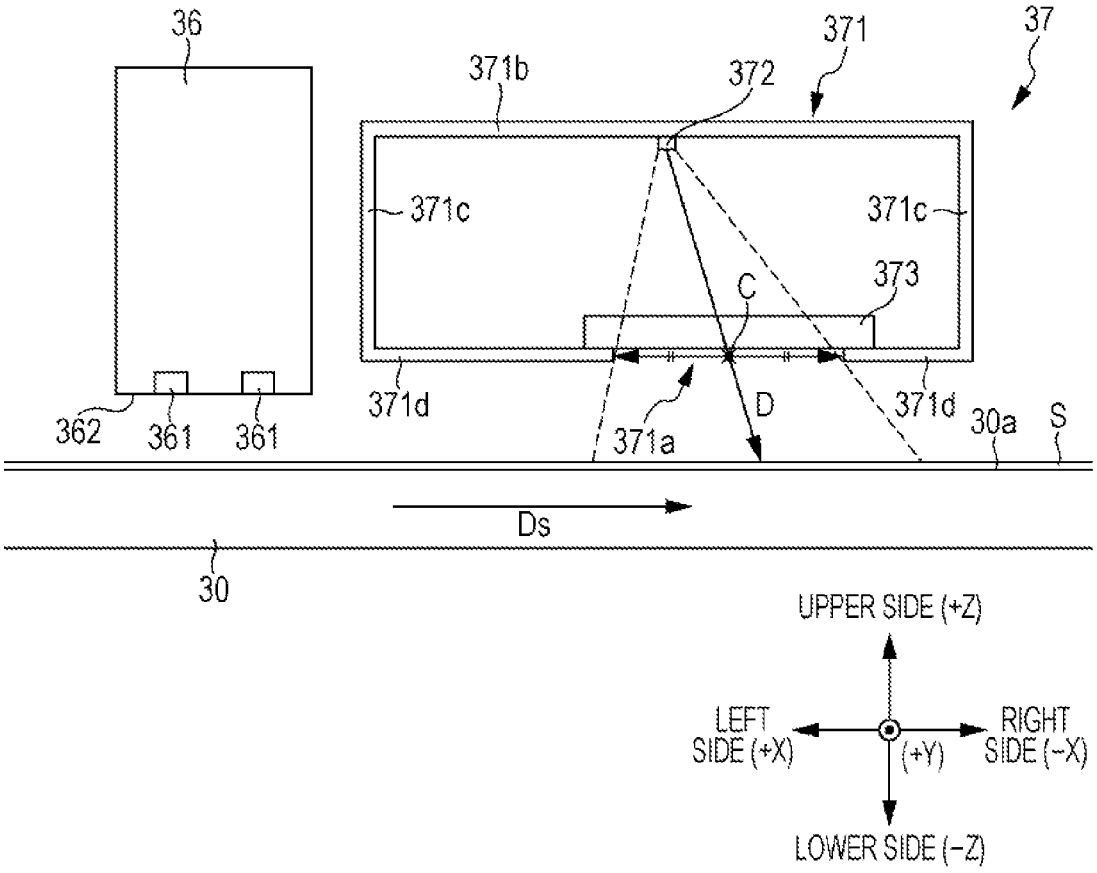
FIG. 7 is a diagram schematically showing a modification example for regulating the direction of the directionality of ultraviolet rays.

In the embodiment, although the configuration is able to impart directionality in the transport direction Ds to the ultraviolet rays irradiated toward the sheet S from the irradiator 37 being rotated around the Y-axis by the rotation mechanism 38, the directionality in the transport direction Ds may be imparted by other methods. For example, FIG. 7 is a diagram schematically showing a form for regulating the directionality of ultraviolet rays by the opening position of the irradiator. In this way, by providing the opening 371*a* such that the center C in the transport direction Ds of the opening 371*a* is further to the downstream side in the transport direction Ds with respect to the light source 372, it is possible to set the direction (direction of the directionality) D from the light source 372 towards the center C in the transport direction Ds of the opening 371*a* to a direction receding from the print head 36 in the transport direction Ds. Meanwhile, if the position of the opening 371*a* is shifted further to the upstream side in the transport direction Ds with respect to the light source 372, it is possible to set the direction (direction of the directionality) D from the light source 372 towards the center in the transport direction Ds of the opening 371*a* to a direction approaching from the print head 36 in the transport direction Ds. In short, in FIG. 7, by changing the position in the transport direction Ds of the opening 371*a* formed in the irradiator 37, the position of the opening 371*a* changes with respect to the light source 372 in the transport direction Ds, and regulates the direction D of the directionality of the ultraviolet rays irradiated by the irradiator 37.

In the embodiment, the direction of the directionality of the ultraviolet rays irradiated from the irradiator 37 is eventually regulated by the relative positions of the light source 372 and the opening 371*a* in the transport direction Ds. However, the ultraviolet rays themselves irradiated from the light source 372 may have directionality in the transport direction Ds. Alternatively, a lens may be provided with respect to the light source 372 and the directionality of the ultraviolet rays irradiated from the irradiator 37 may be regulated by the center line of the luminous flux regulated by the lens.

The composition of the liquid discharged from each of the print heads 36*a* to 36*d* may be changed as appropriate, and it is possible to appropriately change the type of light irradiated from each of the irradiators 37*a* to 37*d* and the liquid discharged from each of the print heads 36*a* to 36*d*. For example, the type of polyfunctional monomer contained may be changed as appropriate, or a plurality of types of polyfunctional monomers may be included in the liquid. In addition, it is possible to appropriately change the type of cleaning solution used during wiping by the maintenance unit 50.

Although each irradiator 37*a* to 37*d* is configured to be rotatable by a rotation mechanism 38 in the embodiments, the irradiators may be arranged inclined by a predetermined angle, without providing the rotary mechanism.

It is possible to appropriately change the specific configuration of the image recording unit 3U. For example, although the print heads 36*a* to 36*d* that correspond to the four colors in the embodiments are provided, print heads that discharge other colors of ink may be further provided. In addition, it is possible to appropriately increase the number of irradiators according to the number of print heads.

The entire disclosure of Japanese Patent Application No. 2013-071615, filed Mar. 29, 2013 is expressly incorporated by reference herein.

What is claimed is:

1. An image recording apparatus comprising:

a transport unit that transports a recording medium in a transport direction;

a first print head that discharges a first liquid that is cured through irradiation of light from a nozzle formed in a nozzle forming surface towards the recording medium;

a second print head that is provided at a different position in the transport direction from the first print head to discharge a second liquid in which a content rate of a tri-functional or higher polyfunctional monomer of the second liquid is different from a content rate of the tri-functional or higher polyfunctional monomer of the first liquid and that is cured through irradiation of light from a nozzle formed in a nozzle forming surface towards the recording medium; and a first irradiator that is arranged between the first print head and the second print head in the transport direction to irradiate the recording medium with light, wherein the first irradiator emits light having directionality in a direction receding in the transport direction from the one of the first print head or second print head that discharges a liquid with a higher content rate of the tri-functional or higher polyfunctional monomer.

2. The image recording apparatus according to claim 1, further comprising:

a maintenance mechanism that washes the nozzle forming surface of the first print head and the nozzle forming surface of the second print head using a cleaning solution, wherein the solubility of the first liquid and the second liquid cured by light with respect to the cleaning solution is greater for the liquid with the lower content rate.

3. The image recording apparatus according to claim 1 further comprising:

a third print head that discharges a third liquid that is cured through irradiation of light towards the recording medium; and a second irradiator that irradiates the recording medium with light, wherein the first print head, the first irradiator, the second print head, the second irradiator, and the third print head are arranged in that order from the upstream side in the transport direction towards the downstream side, the second print head discharges the second liquid in which the content rate is lower than the first liquid and the third liquid, the first irradiator emits light having directionality in a direction receding from the first print head in the transport direction, and the second irradiator emits light having directionality in a direction receding from the third print head in the transport direction.

4. The image recording apparatus according to claim 3, wherein a color of the second liquid is magenta, a color of the first liquid is one of either of cyan or black, and a color of the third liquid is the other of either of cyan or black.

5. The image recording apparatus according to claim 4, wherein the color of the first liquid is cyan, and the color of the third liquid is black.

6. The image recording apparatus according to claim 1 further comprising:

a third print head that discharges a third liquid that is cured through irradiation of light towards the recording medium; and a second irradiator that irradiates the recording medium with light, wherein the first print head, the first irradiator, the second print head, the second irradiator, and the third print head are arranged in that order from the upstream side in the transport direction towards the downstream side, the second print head discharges the second liquid in which the content rate is higher than the first liquid and the third liquid, the first irradiator emits light having directionality in a direction receding from the second print head in the transport direction, and the second irradiator emits light having directionality receding from the second head in the transport direction.

7. The image recording apparatus according to claim 6, wherein the color of the second liquid is black, the color of the first liquid is one of either magenta or yellow, and the color of the third liquid is the other of either magenta or yellow.

8. The image recording apparatus according to claim 7, wherein the color of the first liquid is magenta, and the color of the third liquid is yellow.

9. The image recording apparatus according to claim 1 further comprising:

a third print head that discharges a third liquid that is cured through irradiation of light towards the recording medium;

a fourth print head that discharges a fourth liquid that is cured through irradiation of light towards the recording medium;

a second irradiator that irradiates the recording medium with light; and a third irradiator that irradiates the recording medium with light, wherein the first print head, the first irradiator, the second print head, the second irradiator, the third print head, the third irradiator, and the fourth print head are arranged in that order from the upstream side in the transport direction towards the downstream side, the second print head discharges the second liquid in which the content rate is lower than the first liquid, the third print head discharges the third liquid in which the content rate is higher than the second liquid, the fourth print head discharges the fourth liquid in which the content rate is lower than the third liquid, the first irradiator emits light having directionality in a direction receding from the first print head in the transport direction, the second irradiator emits light having directionality in a direction receding from the third print head in the transport direction, and the third irradiator emits light having directionality in a direction receding from the third print head in the transport direction.

10. The image recording apparatus according to claim 9, wherein the color of the first liquid is cyan, the color of the second liquid is magenta, the color of the third liquid is black, and the color of the fourth liquid is yellow.

11. The image recording apparatus according to claim 9 further comprising:

a fourth irradiator that irradiates the recording medium with light and arranged further to the downstream side in the transport direction from the fourth print head, wherein the fourth irradiator emits light having directionality in a direction receding from the fourth print head in direction perpendicular to the transport direction or in the transport direction.

12. The image recording apparatus according to claim 1, wherein the polyfunctional monomer is a heptafunctional or higher monomer.

13. The image recording apparatus according to claim 1, wherein each irradiator includes a housing in which an opening that opposes the recording medium is provided, and a light source that is provided in the housing to emit light, and wherein a direction of directionality of the light irradiated by each irradiator is regulated by arranging the irradiator such that an optical of the light source is inclined with respect to a perpendicular line descending from the light source to the recording medium.

14. The image recording apparatus according to claim 1, wherein each irradiator includes a housing in which an opening that opposes the recording medium is provided, and a light source that is provided in the housing to emit light, wherein a direction of directionality of the light emitted by each irradiator is regulated by the position of the opening with respect to the light source in the transport direction.

15. The image recording apparatus according to claim 1 further comprising:

a cylindrical support member that includes a rotary axis orthogonal to the transport direction and that supports the recording medium with an outer peripheral surface, wherein each print head and each irradiator are respectively arranged along the outer peripheral surface.

* * * * *